US011353176B1

(12) United States Patent
Chen

(10) Patent No.: US 11,353,176 B1
(45) **Date of Patent: *Jun. 7, 2022**

(54) DECORATIVE LIGHTING CONTROL

(71) Applicant: Willis Electric Co., Ltd., Taipei (TW)

(72) Inventor: Johnny Chen, Taipei (TW)

(73) Assignee: Willis Electric Co., Ltd., Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/204,395

(22) Filed: Mar. 17, 2021

Related U.S. Application Data

(63) Continuation of application No. 16/871,858, filed on May 11, 2020, now Pat. No. 10,989,374, which is a (Continued)

(51) Int. Cl.

| | |
|---|---|
| ***F21S 4/15*** | (2016.01) |
| ***F21S 4/10*** | (2016.01) |
| ***F21V 23/06*** | (2006.01) |
| ***A47G 33/06*** | (2006.01) |
| ***F21S 4/22*** | (2016.01) |
| ***F21W 121/04*** | (2006.01) |
| ***A47G 33/08*** | (2006.01) |

(52) U.S. Cl.
CPC ..... *F21S 4/15* (2016.01); *A47G 33/06* (2013.01); *F21S 4/10* (2016.01); *F21S 4/22* (2016.01); *F21V 23/06* (2013.01); *A47G 2033/0827* (2013.01); *F21W 2121/04* (2013.01)

(58) Field of Classification Search
None
See application file for complete search history.

(56) References Cited

U.S. PATENT DOCUMENTS 377,953 A 2/1888 Mills
438,310 A 10/1890 Edison
(Continued)

FOREIGN PATENT DOCUMENTS

CA 1182513 A 2/1985
CN 2102058 U 4/1992
(Continued)

OTHER PUBLICATIONS

U.S. Appl. No. 17/207,995, filed Mar. 22, 2021.
(Continued)

*Primary Examiner* — Alexander K Garlen
(74) *Attorney, Agent, or Firm* — Christensen, Fonder, Dardi & Herbert PLLC

(57) ABSTRACT

A multi-sectional artificial tree with internal and external power wiring for distributing and controlling power to a network of lights. The tree includes multiple tree sections, each tree section with a set of power wires inside a tree trunk, and a network of lighting wires outside the trunk. The network of lighting wires includes a tree-section wire network with a large gauge wire supplying power to groups of lights strings on branches on the tree trunk. Each group of branches has a branch-level lighting network with multiple connectors in series, and that connects to one connector of the tree-section wire network. Each branch-level lighting network powers multiple light strings connected in series, one light string per branch. The wires of the light strings are small gauge, and are connected by the branch-level connectors by a small-wire-to-large-wire connector.

14 Claims, 14 Drawing Sheets

Related U.S. Application Data continuation of application No. 16/216,800, filed on Dec. 11, 2018, now Pat. No. 10,683,974.

(60) Provisional application No. 62/597,358, filed on Dec. 11, 2017.

(56) References Cited

U.S. PATENT DOCUMENTS

| | | | |
|---|---|---|---|
| 735,010 | A | 7/1903 | Zahl |
| 860,406 | A | 7/1907 | McGahan |
| 1,314,008 | A | 8/1919 | McWilliams |
| 1,372,777 | A | 3/1921 | Samuel et al. |
| 1,495,695 | A | 5/1924 | Karr |
| 1,536,332 | A | 5/1925 | Dam |
| 1,590,220 | A | 6/1926 | Wurts |
| 1,694,974 | A | 12/1928 | Glover |
| 2,025,189 | A | 12/1935 | Yanchenko |
| 2,050,364 | A | 8/1936 | Morton |
| 2,072,337 | A | 3/1937 | Kamm |
| 2,112,281 | A | 3/1938 | Ferris |
| 2,186,351 | A | 1/1940 | Stojaneck |
| 2,188,529 | A | 1/1940 | Corina |
| 2,201,045 | A | 5/1940 | Lundstrom |
| 2,229,211 | A | 1/1941 | Korengold |
| 2,679,911 | A | 8/1948 | Bhend |
| 2,466,499 | A | 4/1949 | Sokolik |
| 2,484,596 | A | 10/1949 | Waltz |
| 2,533,374 | A | 12/1950 | Hyland |
| 2,563,713 | A | 8/1951 | Frei et al. |
| 2,570,751 | A | 10/1951 | Benander |
| 2,636,069 | A | 4/1953 | Gilbert |
| 2,782,296 | A | 2/1957 | Walter |
| 2,806,938 | A | 9/1957 | Henry |
| 2,857,506 | A | 10/1958 | Minteer |
| 2,863,037 | A | 12/1958 | Johnstone |
| 2,910,842 | A | 11/1959 | Sensenig |
| 2,932,811 | A | 4/1960 | Abraham et al. |
| 2,969,456 | A | 1/1961 | Raymaley |
| 2,973,546 | A | 3/1961 | Roche |
| 2,984,813 | A | 5/1961 | Bossi |
| 3,107,966 | A | 10/1963 | Bonhomme |
| 3,115,435 | A | 12/1963 | Abramson |
| 3,118,617 | A | 1/1964 | Hellrich |
| 3,120,351 | A | 2/1964 | Kirsten |
| 3,131,112 | A | 4/1964 | Abramson |
| 3,214,579 | A | 10/1965 | Pacini |
| 3,233,207 | A | 2/1966 | Ahroni et al. |
| 3,286,088 | A | 11/1966 | Ahroni |
| 3,296,430 | A | 1/1967 | Eckert |
| 3,345,482 | A | 10/1967 | Lou |
| 3,398,260 | A | 8/1968 | Martens |
| 3,409,867 | A | 11/1968 | Lessner |
| 3,470,527 | A | 9/1969 | Bonhomme |
| 3,504,169 | A | 3/1970 | Freeburger |
| 3,513,063 | A | 3/1970 | Sloane |
| 3,521,216 | A | 7/1970 | Tolegian |
| 3,522,579 | A | 8/1970 | Matsuya |
| 3,571,586 | A | 3/1971 | Duckworth |
| 3,574,102 | A | 4/1971 | Hermanson |
| 3,585,564 | A | 6/1971 | Skjervoll |
| 3,594,260 | A | 7/1971 | Dieffenbach |
| 3,603,780 | A | 9/1971 | Lu |
| 3,616,107 | A | 10/1971 | Kershner |
| 3,617,732 | A | 11/1971 | Fisher |
| 3,640,496 | A | 2/1972 | Duncan |
| 3,663,924 | A | 5/1972 | Gerlat |
| 3,704,366 | A | 11/1972 | Korb et al. |
| 3,715,708 | A | 2/1973 | Lloyd et al. |
| 3,728,787 | A | 4/1973 | McDonough |
| 3,748,488 | A | 7/1973 | David, Jr. |
| 3,764,862 | A | 10/1973 | Jankowski |
| 3,783,437 | A | 1/1974 | Graff et al. |
| 3,806,399 | A | 4/1974 | Cocjin |
| 3,808,450 | A | 4/1974 | Davis, Jr. |
| 3,812,380 | A | 5/1974 | Davis, Jr. |
| 3,819,457 | A | 6/1974 | Mottel |
| 3,819,459 | A | 6/1974 | Wren |
| 3,834,976 | A | 9/1974 | Mottel |
| 3,862,434 | A | 1/1975 | Davis, Jr. |
| 3,864,580 | A | 2/1975 | Davis, Jr. |
| 3,914,786 | A | 10/1975 | Grossi |
| 3,970,834 | A | 7/1976 | Smith |
| 3,971,619 | A | 7/1976 | Rohrssen |
| 3,985,924 | A | 10/1976 | Pritza |
| 4,012,631 | A | 3/1977 | Creager |
| 4,020,201 | A | 4/1977 | Miller |
| 4,045,868 | A | 9/1977 | Ammon et al. |
| 4,057,735 | A | 11/1977 | Davis, Jr. |
| 4,097,917 | A | 6/1978 | McCaslin |
| 4,109,345 | A | 8/1978 | Sargent et al. |
| 4,125,781 | A | 11/1978 | Davis, Jr. |
| 4,140,823 | A | 2/1979 | Weskamp |
| 4,153,860 | A | 5/1979 | Vonick |
| 4,161,768 | A | 7/1979 | Gauthier et al. |
| 4,215,277 | A | 7/1980 | Weiner et al. |
| 4,245,875 | A | 1/1981 | Shaffer et al. |
| 4,248,916 | A | 2/1981 | Chase |
| 4,273,814 | A | 6/1981 | Koehler |
| 4,291,075 | A | 9/1981 | Puleo |
| 4,305,980 | A | 12/1981 | Koehler |
| 4,340,841 | A | 7/1982 | Schupp |
| 4,343,842 | A | 8/1982 | Chase |
| 4,437,782 | A | 3/1984 | Geisthoff |
| 4,447,279 | A | 5/1984 | Boisvert et al. |
| 4,451,510 | A | 5/1984 | Boisvert et al. |
| 4,462,065 | A | 7/1984 | Rhodes |
| 4,493,523 | A | 1/1985 | Leong et al. |
| 4,496,615 | A | 1/1985 | Huang |
| 4,516,193 | A | 5/1985 | Murphy |
| 4,519,666 | A | 5/1985 | Williams et al. |
| 4,544,218 | A | 10/1985 | Sanders et al. |
| 4,546,041 | A | 10/1985 | Keane et al. |
| 4,573,102 | A | 2/1986 | Norwood |
| 4,590,105 | A | 5/1986 | Shaffer |
| 4,620,270 | A | 10/1986 | Laasko |
| 4,631,650 | A | 12/1986 | Ahroni |
| 4,636,106 | A | 1/1987 | Waisbrod |
| 4,659,597 | A | 4/1987 | Lau |
| 4,662,775 | A | 5/1987 | Faul |
| 4,675,575 | A | 6/1987 | Smith et al. |
| 4,678,926 | A | 7/1987 | Davis |
| 4,712,299 | A | 12/1987 | Loewen et al. |
| 4,720,272 | A | 1/1988 | Durand |
| 4,727,449 | A | 2/1988 | Fleck |
| 4,753,600 | A | 6/1988 | Williams |
| 4,759,729 | A | 7/1988 | Kemppainen et al. |
| 4,761,720 | A | 8/1988 | Solow |
| 4,769,579 | A | 9/1988 | Jou |
| 4,772,215 | A | 9/1988 | Falk |
| 4,774,113 | A | 9/1988 | Shaffer |
| 4,775,922 | A | 10/1988 | Engel |
| 4,777,573 | A | 10/1988 | Liao |
| 4,779,177 | A | 10/1988 | Ahroni |
| 4,789,570 | A | 12/1988 | Maddock |
| 4,799,902 | A | 1/1989 | Laudig et al. |
| 4,805,075 | A | 2/1989 | Damore |
| 4,807,098 | A | 2/1989 | Ahroni |
| 4,808,885 | A | 2/1989 | Bausch et al. |
| 4,812,956 | A | 3/1989 | Chen |
| 4,855,880 | A | 8/1989 | Mancusi Jr. |
| 4,859,205 | A | 8/1989 | Fritz |
| 4,867,690 | A | 9/1989 | Thumma |
| 4,870,547 | A | 9/1989 | Crucefix |
| 4,870,753 | A | 10/1989 | Pfeffer et al. |
| 4,885,664 | A | 12/1989 | Hermanson |
| 4,890,000 | A | 12/1989 | Chou |
| 4,894,019 | A | 1/1990 | Howard |
| 4,899,266 | A | 2/1990 | Ahroni |
| 4,908,743 | A | 3/1990 | Miller |
| 4,921,426 | A | 5/1990 | Kawasaki et al. |
| 4,934,964 | A | 6/1990 | Mazelle |
| 5,015,510 | A | 5/1991 | Smith |
| 5,033,976 | A | 7/1991 | Sarian et al. |
| 5,051,877 | A | 9/1991 | Liao |

(56) References Cited

U.S. PATENT DOCUMENTS 5,071,362 A 12/1991 Martens et al.
5,073,132 A 12/1991 Nottrott
5,088,669 A 2/1992 Zinnbauer
5,091,834 A 2/1992 Kao et al.
5,104,608 A 4/1992 Pickering
5,109,324 A 4/1992 Ahroni
5,121,310 A 6/1992 Ahroni
5,128,595 A 7/1992 Hara
5,139,343 A 8/1992 Lin
5,149,282 A 9/1992 Donato et al.
5,150,964 A 9/1992 Tsui
5,154,508 A 10/1992 Ahroni
5,192,127 A 3/1993 Schaef
5,213,407 A 5/1993 Eisenbraun
5,217,382 A 6/1993 Sparks
5,218,233 A 6/1993 Takahashi
5,281,158 A 1/1994 Lin
5,300,864 A 4/1994 Allen, Jr.
5,334,025 A 8/1994 Föhl
5,342,661 A 8/1994 Wilcox, II
5,349,780 A 9/1994 Dyke
5,350,315 A 9/1994 Cheng et al.
5,366,386 A 11/1994 Liao
5,376,752 A 12/1994 Limeris et al.
5,380,215 A 1/1995 Huang
5,389,008 A 2/1995 Cheng et al.
5,390,463 A 2/1995 Sollner
D356,246 S 3/1995 Adams
5,409,403 A 4/1995 Falossi et al.
5,422,766 A 6/1995 Hack et al.
5,438,154 A 8/1995 Segan et al.
5,442,258 A 8/1995 Shibata
5,451,842 A 9/1995 Chien
5,453,664 A 9/1995 Harris
5,455,750 A 10/1995 Davis et al.
5,456,620 A 10/1995 Kaminski
5,481,444 A 1/1996 Schulz
D367,257 S 2/1996 Buelow et al.
5,492,429 A 2/1996 Hodges
5,495,147 A 2/1996 Lanzisera
5,517,390 A 5/1996 Zins
5,518,425 A 5/1996 Tsai
5,536,538 A 7/1996 Hartung
5,541,818 A 7/1996 Ng et al.
5,550,720 A 8/1996 Carroll
5,559,681 A 9/1996 Duarte
5,560,975 A 10/1996 Casper
D375,483 S 11/1996 Tashiro
5,580,159 A 12/1996 Liu
5,586,905 A 12/1996 Marshall et al.
5,605,395 A 2/1997 Peng
5,607,328 A 3/1997 Joly
5,624,283 A 4/1997 Hotea
5,626,419 A 5/1997 Lin
5,629,587 A 5/1997 Gray et al.
5,639,157 A 6/1997 Yeh
5,652,032 A 7/1997 Kaczor et al.
5,653,616 A 8/1997 Hotea
5,695,279 A 12/1997 Sonnleitner et al.
5,700,082 A 12/1997 Peng
5,702,262 A 12/1997 Brown et al.
5,702,268 A 12/1997 Lien et al.
5,707,136 A 1/1998 Byers
5,709,457 A 1/1998 Hara
5,712,002 A 1/1998 Reilly, III
5,720,544 A 2/1998 Shu
5,722,766 A 3/1998 Shu
5,727,872 A 3/1998 Liou
5,758,545 A 6/1998 Fevre et al.
5,759,062 A 6/1998 Chen
5,775,933 A 7/1998 Chen
5,776,559 A 7/1998 Woolford
5,776,599 A 7/1998 Haluska et al.
5,785,412 A 7/1998 Wu et al.
5,788,361 A 8/1998 Lee
5,791,765 A 8/1998 Lin
5,791,940 A 8/1998 Chen et al.
5,807,134 A 9/1998 Hara
5,816,849 A 10/1998 Schmidt
5,816,862 A 10/1998 Tseng
5,820,248 A 10/1998 Ferguson
5,822,855 A 10/1998 Szczesny et al.
5,828,183 A 10/1998 Wang et al.
5,829,865 A 11/1998 Ahroni
5,834,901 A 11/1998 Shen
5,839,819 A 11/1998 Pan
5,848,838 A 12/1998 Presta
5,852,348 A 12/1998 Lin
5,854,541 A 12/1998 Chou
5,855,705 A 1/1999 Gauthier
5,860,731 A 1/1999 Martinez
5,860,830 A 1/1999 Wu
5,869,151 A 2/1999 Chong
5,878,989 A 3/1999 Allman
5,893,634 A 4/1999 Wang
5,908,238 A 6/1999 Huang
5,921,806 A 7/1999 Shuey
5,934,793 A 8/1999 Rahman
5,937,496 A 8/1999 Benoit et al.
5,938,168 A 8/1999 Adams
5,944,408 A 8/1999 Tong et al.
5,957,723 A 9/1999 Gort-Barten
5,964,520 A 10/1999 Lee
5,966,393 A 10/1999 Hide et al.
5,971,810 A 10/1999 Taylor
5,979,859 A 11/1999 Vartanov et al.
6,004,006 A 12/1999 Wang
6,007,362 A 12/1999 Davis et al.
6,030,670 A 2/2000 Chang
6,042,418 A 3/2000 Cummings
6,053,774 A 4/2000 Lin
6,056,427 A 5/2000 Kao
6,065,233 A 5/2000 Rink
6,079,848 A 6/2000 Ahroni
6,084,357 A 7/2000 Janning
6,086,395 A 7/2000 Lloyd et al.
6,091,204 A 7/2000 Chen
6,095,874 A 8/2000 Quaranta
6,099,920 A 8/2000 Kao
6,102,740 A 8/2000 Murakami et al.
6,111,201 A 8/2000 Drane et al.
6,113,430 A 9/2000 Wu
6,116,563 A 9/2000 Tsai
6,117,503 A 9/2000 Lee et al.
6,120,312 A 9/2000 Shu
6,123,433 A 9/2000 Chen
6,139,376 A 10/2000 Ooya et al.
6,147,367 A 11/2000 Yang et al.
6,149,448 A 11/2000 Haller et al.
6,155,697 A 12/2000 Ahroni
6,162,515 A 12/2000 Hill
6,179,647 B1 1/2001 Kinderman
6,203,169 B1 3/2001 Coushaine et al.
6,217,191 B1 4/2001 Wu et al.
6,217,199 B1 4/2001 Lo
6,228,442 B1 5/2001 Coco
6,241,559 B1 6/2001 Taylor
6,245,425 B1 6/2001 McCullough et al.
6,257,736 B1 7/2001 Fehrenbach
6,257,740 B1 7/2001 Gibboney, Jr.
6,257,793 B1 7/2001 Lin
6,261,119 B1 7/2001 Green
6,273,584 B1 8/2001 Wang et al.
6,276,120 B1 8/2001 Adriaensen et al.
6,283,797 B1 9/2001 Wu
6,285,140 B1 9/2001 Ruxton
6,292,901 B1 9/2001 Lys et al.
6,319,056 B1 11/2001 Schunk et al.
6,320,327 B1 11/2001 Lavatelli et al.
6,328,593 B1 12/2001 Chang et al.
6,347,965 B1 2/2002 Pan
D454,110 S 3/2002 Andre et al.
6,354,719 B1 3/2002 Pan
6,361,186 B1 3/2002 Slayden

(56) References Cited

U.S. PATENT DOCUMENTS

| | | | |
|---|---|---|---|
| 6,361,368 | B1 | 3/2002 | Tseng |
| 6,363,607 | B1 | 4/2002 | Chen et al. |
| 6,368,130 | B1 | 4/2002 | Fukuda |
| 6,382,812 | B1 | 5/2002 | Hsu |
| 6,394,623 | B1 | 5/2002 | Tsui |
| 6,407,411 | B1 | 6/2002 | Wojnarowski et al. |
| 6,452,317 | B1 | 9/2002 | Tseng |
| 6,457,839 | B1 | 10/2002 | Grandoit |
| 6,458,435 | B1 | 10/2002 | Lai |
| 6,497,496 | B2 | 12/2002 | Wang |
| 6,511,206 | B1 | 1/2003 | Fan Wong |
| 6,514,581 | B1 | 2/2003 | Gregory |
| 6,533,437 | B1 | 3/2003 | Ahroni |
| 6,541,800 | B2 | 4/2003 | Barnett et al. |
| 6,544,070 | B1 | 4/2003 | Radliff |
| 6,547,584 | B2 | 4/2003 | Myer et al. |
| 6,566,824 | B2 | 5/2003 | Panagotacos et al. |
| 6,571,340 | B1 | 5/2003 | Lee |
| 6,575,595 | B1 | 6/2003 | Wu |
| 6,576,844 | B1 | 6/2003 | Kamata |
| 6,580,182 | B2 | 6/2003 | Janning |
| 6,582,094 | B2 | 6/2003 | Liu |
| 6,588,914 | B1 | 7/2003 | Tang |
| 6,592,094 | B1 | 7/2003 | Kao |
| 6,592,238 | B2 | 7/2003 | Cleaver et al. |
| 6,595,657 | B1 | 7/2003 | Shieh |
| D478,310 | S | 8/2003 | Andre et al. |
| 6,601,971 | B1 | 8/2003 | Ko |
| 6,604,841 | B2 | 8/2003 | Liu |
| 6,609,814 | B2 | 8/2003 | Ahroni |
| 6,619,831 | B2 | 9/2003 | Kanesaka |
| 6,623,291 | B1 | 9/2003 | Tsai |
| 6,634,766 | B1 | 10/2003 | Gordon |
| 6,641,417 | B2 | 11/2003 | Tanaka |
| 6,644,836 | B1 | 11/2003 | Adams |
| 6,653,797 | B2 | 11/2003 | Puleo, Sr. et al. |
| D483,721 | S | 12/2003 | Kim et al. |
| 6,657,398 | B2 | 12/2003 | Chang |
| 6,666,734 | B2 | 12/2003 | Fukatsu |
| 6,672,750 | B1 | 1/2004 | Kao |
| D486,385 | S | 2/2004 | Smith-Kielland et al. |
| 6,733,167 | B1 | 5/2004 | Kao |
| 6,752,512 | B2 | 6/2004 | Pan |
| 6,774,549 | B2 | 8/2004 | Tsai et al. |
| 6,794,825 | B1 | 9/2004 | Kao |
| 6,805,463 | B2 | 10/2004 | Shieh |
| 6,824,293 | B2 | 11/2004 | Chang |
| 6,830,358 | B2 | 12/2004 | Allen |
| 6,840,655 | B2 | 1/2005 | Shen |
| 6,840,802 | B2 | 1/2005 | Shepherd |
| 6,866,394 | B1 | 3/2005 | Hutchins et al. |
| 6,869,316 | B2 | 3/2005 | Hinkle et al. |
| 6,883,951 | B2 | 4/2005 | Wu |
| 6,884,083 | B2 | 4/2005 | Shepherd |
| 6,908,215 | B2 | 6/2005 | Wu |
| 6,914,194 | B2 | 7/2005 | Fan |
| 6,929,383 | B1 | 8/2005 | Janning |
| D509,797 | S | 9/2005 | Milan |
| 6,942,355 | B1 | 9/2005 | Castiglia |
| 6,951,405 | B2 | 10/2005 | Yao |
| 6,957,971 | B2 | 10/2005 | Wu |
| 6,962,498 | B2 | 11/2005 | Kohen |
| 7,000,999 | B2 | 2/2006 | Ryan, Jr. |
| 7,014,352 | B2 | 3/2006 | Wu |
| 7,021,598 | B2 | 4/2006 | Kao |
| 7,029,145 | B2 | 4/2006 | Frederick |
| 7,045,965 | B2 | 5/2006 | Li et al. |
| 7,052,156 | B2 | 5/2006 | Primeau |
| 7,055,980 | B2 | 6/2006 | Wu |
| 7,055,981 | B2 | 6/2006 | Yao |
| 7,066,628 | B2 | 6/2006 | Allen |
| 7,066,739 | B2 | 6/2006 | McLeish |
| 7,088,904 | B2 | 8/2006 | Ryan, Jr. |
| 7,108,514 | B2 | 9/2006 | Chen et al. |
| D530,277 | S | 10/2006 | Lin |
| 7,118,249 | B2 | 10/2006 | Hsu et al. |
| 7,132,139 | B2 | 11/2006 | Yang |
| 7,144,610 | B1 | 12/2006 | Estes et al. |
| 7,145,105 | B2 | 12/2006 | Gaulard |
| 7,147,518 | B2 | 12/2006 | Marechal et al. |
| 7,160,140 | B1 | 1/2007 | Mrakovich et al. |
| 7,186,050 | B2 | 3/2007 | Dean et al. |
| 7,192,303 | B2 | 3/2007 | Kohen |
| 7,204,720 | B1 | 4/2007 | Shiu |
| 7,207,844 | B2 | 4/2007 | Peng |
| 7,235,815 | B2 | 6/2007 | Wang |
| 7,253,556 | B1 | 8/2007 | Gibboney |
| 7,253,714 | B1 | 8/2007 | Tsui |
| 7,264,392 | B2 | 9/2007 | Massabki et al. |
| 7,270,450 | B2 | 9/2007 | Chan |
| 7,311,566 | B2 | 12/2007 | Dent |
| 7,315,692 | B2 | 1/2008 | Chow |
| 7,318,744 | B2 | 1/2008 | Kuo |
| 7,326,091 | B2 | 2/2008 | Nania et al. |
| 7,371,115 | B1 | 5/2008 | Hsieh et al. |
| 7,393,019 | B2 | 7/2008 | Taga et al. |
| 7,422,489 | B1 | 9/2008 | Tseng |
| D580,355 | S | 11/2008 | Hussaini et al. |
| 7,445,824 | B2 | 11/2008 | Leung et al. |
| 7,453,194 | B1 | 11/2008 | Gibboney |
| D582,846 | S | 12/2008 | Lett |
| 7,462,066 | B2 | 12/2008 | Kohen |
| D585,384 | S | 1/2009 | Andre et al. |
| 7,473,024 | B2 | 1/2009 | Gibboney |
| 7,481,555 | B2 | 1/2009 | Huang |
| 7,527,508 | B1 | 5/2009 | Lee et al. |
| 7,554,266 | B1 | 6/2009 | Chen |
| D598,374 | S | 8/2009 | Sasada |
| 7,575,362 | B1 | 8/2009 | Hsu |
| 7,581,870 | B2 | 9/2009 | Massabki et al. |
| 7,585,187 | B2 | 9/2009 | Daily et al. |
| 7,585,552 | B2 | 9/2009 | Meseke |
| 7,609,006 | B2 | 10/2009 | Gibboney |
| D608,685 | S | 1/2010 | Krize |
| 7,652,210 | B2 | 1/2010 | White |
| D609,602 | S | 2/2010 | Krize |
| D611,409 | S | 3/2010 | Green et al. |
| 7,695,298 | B2 | 4/2010 | Arndt et al. |
| 7,893,627 | B2 | 2/2011 | Li |
| 7,926,978 | B2 | 4/2011 | Tsai |
| D638,355 | S | 5/2011 | Chen |
| 8,007,129 | B2 | 8/2011 | Yang |
| 8,047,700 | B2 | 11/2011 | Massabki et al. |
| 8,053,042 | B1 | 11/2011 | Loomis |
| 8,062,718 | B2 | 11/2011 | Schooley |
| 8,092,255 | B2 | 1/2012 | Wang |
| 8,096,833 | B2 | 1/2012 | Tobey |
| 8,100,546 | B2 | 1/2012 | Lutz et al. |
| 8,113,889 | B2 | 2/2012 | Zhang et al. |
| 8,132,360 | B2 | 3/2012 | Jin et al. |
| 8,132,649 | B2 | 3/2012 | Rogers |
| 8,203,275 | B2 | 6/2012 | Ruxton |
| 8,235,737 | B2 | 8/2012 | Cheng et al. |
| 8,298,633 | B1 | 10/2012 | Chen |
| 8,348,466 | B2 | 1/2013 | Plumb et al. |
| D678,211 | S | 3/2013 | Chen |
| 8,390,306 | B2 | 3/2013 | Hamann et al. |
| 8,397,381 | B2 | 3/2013 | Tsai |
| 8,450,950 | B2 | 5/2013 | McRae |
| 8,454,186 | B2 | 6/2013 | Chen |
| 8,454,187 | B2 | 6/2013 | Chen |
| 8,469,734 | B2 | 6/2013 | Chen |
| 8,469,750 | B2 | 6/2013 | Chen |
| D686,523 | S | 7/2013 | Chen |
| 8,491,323 | B2 | 7/2013 | Ishibashi |
| 8,534,186 | B2 | 9/2013 | Glucksman et al. |
| 8,562,175 | B2 | 10/2013 | Chen |
| 8,568,015 | B2 | 10/2013 | Chen |
| 8,569,960 | B2 | 10/2013 | Chen |
| 8,573,548 | B2 | 11/2013 | Kuhn et al. |
| 8,592,845 | B2 | 11/2013 | Chen |
| D696,153 | S | 12/2013 | Chen |
| 8,599,108 | B2 | 12/2013 | Kline et al. |
| 8,608,342 | B2 | 12/2013 | Chen |

(56) References Cited

U.S. PATENT DOCUMENTS 8,641,229 B2 2/2014 Li
8,777,648 B2 7/2014 Kitajima et al.
8,853,721 B2 10/2014 Chen
8,863,416 B2 10/2014 Leung et al.
8,870,404 B1 10/2014 Chen
8,876,321 B2 11/2014 Chen
8,916,242 B2 12/2014 Fu et al.
8,959,810 B1 2/2015 Leung et al.
8,974,072 B2 3/2015 Chen
9,044,056 B2 6/2015 Chen
9,055,777 B2 6/2015 Chen
9,057,493 B2 6/2015 Simon et al.
9,066,617 B2 6/2015 Chen
9,119,495 B2 9/2015 Leung et al.
9,140,438 B2 9/2015 Chen
9,157,587 B2 10/2015 Chen
9,157,588 B2 10/2015 Chen
9,179,793 B2 11/2015 Chen
9,220,361 B1 12/2015 Chen
9,222,656 B2 12/2015 Chen
9,243,788 B2 1/2016 Chen
9,291,318 B1 3/2016 Benson
9,402,498 B2 8/2016 McRae
9,439,528 B2 9/2016 Chen
9,441,800 B1 9/2016 Chen
9,441,823 B1 9/2016 Chen
9,526,286 B2 12/2016 Chen
9,572,446 B2 2/2017 Chen
9,593,831 B2 3/2017 Chen
9,648,919 B2 5/2017 Chen
9,617,074 B2 6/2017 Chen
9,671,097 B2 6/2017 Chen
9,677,748 B1 6/2017 Chen
9,677,749 B2 6/2017 Chen
9,700,169 B2 7/2017 Wong
9,781,781 B2 10/2017 Huang et al.
9,883,556 B2 1/2018 Chen
10,184,654 B1 1/2019 Chen
10,288,235 B1 5/2019 Chen
10,288,236 B1 5/2019 Chen
10,982,828 B1 4/2021 Chen
2002/0002015 A1 1/2002 Mochizuki et al.
2002/0097573 A1 7/2002 Shen
2002/0109989 A1 8/2002 Chuang
2002/0118540 A1 8/2002 Ingrassia
2002/0149936 A1 10/2002 Mueller et al.
2003/0063463 A1 4/2003 Sloan et al.
2003/0096542 A1 5/2003 Kojima
2003/0121781 A1 7/2003 Prohaska et al.
2003/0142494 A1 7/2003 Ahroni
2003/0198044 A1 10/2003 Lee
2003/0198048 A1 10/2003 Frederick
2003/0206412 A1 11/2003 Gordon
2003/0218412 A1 11/2003 Shieh
2003/0231779 A1 12/2003 Billington
2004/0004435 A1 1/2004 Hsu
2004/0012950 A1 1/2004 Pan
2004/0080281 A1 4/2004 Pan
2004/0090770 A1 5/2004 Primeau
2004/0096596 A1 5/2004 Palmer, III et al.
2004/0105270 A1 6/2004 Shieh
2004/0115984 A1 6/2004 Rudy et al.
2004/0145916 A1 7/2004 Wu
2004/0161552 A1 8/2004 Butts, Jr.
2004/0182597 A1 9/2004 Smith et al.
2004/0246718 A1 12/2004 Fan
2005/0048226 A1 3/2005 Gary et al.
2005/0077525 A1 4/2005 Lynch et al.
2005/0122723 A1 6/2005 Frederick
2005/0201068 A1 9/2005 Kramer et al.
2005/0239308 A1 10/2005 Cummings et al.
2005/0249892 A1 11/2005 Rocheleau
2005/0270797 A1 12/2005 Lin
2005/0286267 A1 12/2005 Wang
2006/0000634 A1 1/2006 Arakawa
2006/0048397 A1 3/2006 King et al.
2006/0093308 A1 5/2006 Ryan
2006/0146578 A1 7/2006 Kuo
2006/0158138 A1 7/2006 Walter
2006/0164834 A1 7/2006 Kao
2006/0221609 A1 10/2006 Ryan, Jr.
2006/0270250 A1 11/2006 Allen
2006/0274556 A1 12/2006 Massabki et al.
2007/0091606 A1 4/2007 Reed
2007/0092664 A1 4/2007 Chun
2007/0159109 A1 7/2007 Gibboney
2007/0177402 A1 8/2007 Wu
2007/0230174 A1 10/2007 Hicks et al.
2007/0253191 A1 11/2007 Chin et al.
2007/0273296 A9 11/2007 Janning
2008/0007951 A1 1/2008 Chan
2008/0025024 A1 1/2008 Yu
2008/0049424 A1 2/2008 Wang
2008/0084695 A1 4/2008 Hsu
2008/0094828 A1 4/2008 Shao
2008/0107840 A1 5/2008 Leung et al.
2008/0149791 A1 6/2008 Bradley
2008/0186731 A1 8/2008 Graham
2008/0186740 A1 8/2008 Huang et al.
2008/0205020 A1 8/2008 Vich
2008/0218092 A1 9/2008 Chang
2008/0283717 A1 11/2008 Kim et al.
2008/0296604 A1 12/2008 Chou et al.
2008/0299817 A1 12/2008 Liu
2008/0303446 A1 12/2008 Ding
2008/0307646 A1 12/2008 Zaderej et al.
2009/0002991 A1 1/2009 Huang
2009/0003012 A1 1/2009 Hsu
2009/0023315 A1 1/2009 Pfeiffer
2009/0059578 A1 3/2009 Lau
2009/0213620 A1 8/2009 Lee
2009/0260852 A1 10/2009 Schaffer
2009/0289560 A1 11/2009 Oliva
2010/0000065 A1 1/2010 Cheng et al.
2010/0053991 A1 3/2010 Boggs
2010/0067242 A1 3/2010 Fung
2010/0072747 A1 3/2010 Krize
2010/0099287 A1 4/2010 Colburn et al.
2010/0136808 A1 6/2010 Vanzo
2010/0159713 A1 6/2010 Nishihira et al.
2010/0195332 A1 8/2010 Wasem
2010/0196628 A1 8/2010 Shooley
2010/0263911 A1 10/2010 Watanabe
2011/0062875 A1 3/2011 Altamura
2011/0062896 A1 3/2011 Altamura
2011/0076425 A1 3/2011 Cheng et al.
2011/0228535 A1 9/2011 Shao
2011/0256750 A1 10/2011 Chen
2012/0002407 A1 1/2012 Li et al.
2012/0009360 A1 1/2012 Fu et al.
2012/0076957 A1 3/2012 Chen
2012/0098465 A1 4/2012 Rothschild
2013/0093334 A1 4/2013 Lin et al.
2013/0107514 A1 5/2013 McNabb et al.
2013/0108808 A1 5/2013 Leung et al.
2013/0119893 A1 5/2013 Chen
2013/0120971 A1 5/2013 Chen
2013/0163231 A1 6/2013 Chen
2013/0301245 A1 11/2013 Chen
2013/0301246 A1 11/2013 Chen
2013/0301247 A1 11/2013 Chen
2013/0308301 A1 11/2013 Chen
2013/0309908 A1 11/2013 Sandoval et al.
2014/0087094 A1 3/2014 Leung et al.
2014/0215864 A1 8/2014 Fischer, Jr. et al.
2014/0218925 A1 8/2014 Han et al.
2014/0268689 A1 9/2014 Chen
2014/0287618 A1 9/2014 Chen
2014/0334134 A1 11/2014 Loomis
2015/0029703 A1 1/2015 Chen
2015/0070878 A1 3/2015 Yu
2015/0077999 A1 3/2015 Chen
2015/0157159 A1 6/2015 Leung et al.
2015/0211726 A1 7/2015 Wu Lee

(56) References Cited

U.S. PATENT DOCUMENTS

| | | | |
|---|---|---|---|
| 2015/0272250 | A1 | 10/2015 | Chen |
| 2016/0007430 | A1 | 1/2016 | Kidakarn |
| 2016/0021957 | A1 | 1/2016 | Chen |
| 2016/0021958 | A1 | 1/2016 | Chen |
| 2016/0033097 | A1 | 2/2016 | Chen |
| 2016/0341408 | A1 | 11/2016 | Altamura |

FOREIGN PATENT DOCUMENTS

| | | | |
|---|---|---|---|
| CN | 2242654 | Y | 12/1996 |
| CN | 1181693 | | 5/1998 |
| CN | 2332290 | Y | 8/1999 |
| CN | 2484010 | Y | 4/2002 |
| CN | 1509670 | A | 7/2004 |
| CN | 2631782 | Y | 8/2004 |
| CN | 2751226 | Y | 1/2006 |
| CN | 100409504 | C | 9/2007 |
| CN | 200982547 | Y | 11/2007 |
| CN | 100409506 | C | 8/2008 |
| CN | 201121811 | Y | 9/2008 |
| CN | 201187701 | Y | 1/2009 |
| CN | 201829727 | U | 5/2011 |
| CN | 201897194 | U | 7/2011 |
| CN | 201898147 | U | 7/2011 |
| CN | 201966240 | U | 9/2011 |
| CN | 102224645 | A | 10/2011 |
| CN | 202473 314 | U | 10/2012 |
| CN | 202613183 | U | 12/2012 |
| CN | 203703878 | U | 7/2014 |
| DE | 32 40 446 | A1 | 7/1983 |
| DE | 8436328 | | 4/1985 |
| DE | 10235081 | A1 | 2/2004 |
| EP | 434425 | A1 | 6/1991 |
| EP | 0552741 | | 7/1993 |
| EP | 0342050 | | 8/1995 |
| EP | 0727842 | | 8/1996 |
| EP | 895742 | B1 | 2/1999 |
| EP | 0920826 | A1 | 6/1999 |
| EP | 1 049 206 | A2 | 11/2000 |
| EP | 1763115 | A2 | 3/2007 |
| EP | 2533374 | A1 | 12/2012 |
| FR | 1215214 | | 4/1960 |
| GB | 1150390 | | 4/1969 |
| GB | 1245214 | | 9/1971 |
| GB | 2112281 | A | 7/1983 |
| GB | 2137086 | A | 10/1984 |
| GB | 2 169 198 | A | 7/1986 |
| GB | 2172135 | A | 9/1986 |
| GB | 2178910 | A | 2/1987 |
| GB | 2208336 | A | 3/1989 |
| GB | 2221104 | A | 1/1990 |
| GB | 2396686 | A | 6/2000 |
| GB | 2 454 546 | A | 5/2009 |
| JP | Hl 1121123 | A | 4/1999 |
| WO | WO 91/10093 | | 7/1991 |
| WO | WO 96/24966 | | 8/1996 |
| WO | WO 96/26661 | A1 | 9/1996 |
| WO | WO 2002/075862 | | 9/2002 |
| WO | WO 2004/008581 | A1 | 1/2004 |
| WO | WO 2007/140648 | A1 | 12/2007 |
| WO | WO 2009/115860 | A1 | 9/2009 |
| WO | WO 2010/082049 | A1 | 2/2010 |

OTHER PUBLICATIONS

Holtek, "HT2040A Christmas Light Controller" (Mar. 26, 1997) 9 pgs.

Mosdesign Semiconductor Corp. "8 Functions Xmas Light Control" (May 14, 2002) (2 pgs.).

DECORATIVE LIGHTING CONTROL

PRIORITY CLAIM

This application is a continuation of U.S. application Ser. No. 16/871,858, filed May 11, 2020, which is a continuation of U.S. application Ser. No. 16/216,800, filed Dec. 11, 2018, which claims the benefit of U.S. Provisional Patent Application No. 62/597,358, filed Dec. 11, 2017, the contents of which are incorporated herein by reference in their entireties.

FIELD OF THE DISCLOSURE

The present disclosure relates to decorative lighting control. More specifically, the present disclosure relates to devices, systems and methods of efficiently powering and controlling power and data of decorative lighting systems.

BACKGROUND OF THE DISCLOSURE

Basic control of lights of decorative lighting products, such as light strings, artificial lighted trees (pre-lit trees), net lights, icicle lights, to create lighting effects such as flashing, color changing, and so on, is well known. However, known systems and methods for controlling such lights remain deficient, as do wiring networks to selectively power and control the lights.

SUMMARY OF THE DISCLOSURE

Various embodiments of the disclosure include devices, systems and methods relating to control of decorative lighting. Embodiments include a variety of decorative lighting devices and systems that may be used for decoration, including holiday decoration, such as strings of lights, pre-lit or lighted artificial Christmas trees, icicle lights, net lights, and other such types of decorative lighting applications and apparatuses that may include LEDs, incandescent or other types of light elements. In some embodiments, a power source may provide an incoming alternating-current (AC) power, such as that provided to most homes and businesses. A decorative lighting device or system of the disclosure, such as one that includes light elements that comprise LEDs, may convert incoming AC power to direct-current (DC) power for use with control electronics and to power LEDs. In other embodiments, AC power may be used to power light elements that comprise incandescent or LED light elements.

In embodiments, both AC and DC power are utilized, for example, by providing AC power to a power receptacle of the decorative lighting device or system, and DC power to light elements. In an embodiment, a power receptacle transmitting AC power may be used to power an additional decorative lighting device or system, for example, a second string of lights, an AC-powered tree-top ornament, or another AC-powered device.

Embodiments of the disclosure include devices, systems and methods of controlling decorative lighting that utilizes AC power, DC power, or both. "Control" may include, but not be limited to methods for achieving light element color selection, brightness control, fading, flashing and other functions for selectively powering light elements on and off. While control systems and methods for achieving basic functions are known, embodiments of the present disclosure go further and incorporate system timing and control functions for both DC light elements and AC accessory power receptacles.

In one embodiment, the invention comprises a multi-sectional artificial tree with internal and external power wiring for distributing and controlling power to a network of lights. The tree includes multiple tree sections, each tree section with a set of power wires inside a tree trunk, and a network of lighting wires outside the trunk. The network of lighting wires includes a tree-section wire network with a large gauge wire supplying power to groups of lights strings on branches on the tree trunk. Each group of branches has a branch-level lighting network with multiple connectors in series, and that connects to one connector of the tree-section wire network. Each branch-level lighting network powers multiple light strings connected in series, one light string per branch. The wires of the light strings are small gauge, and are connected by the branch-level connectors by a small-wire-to-large-wire connector.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
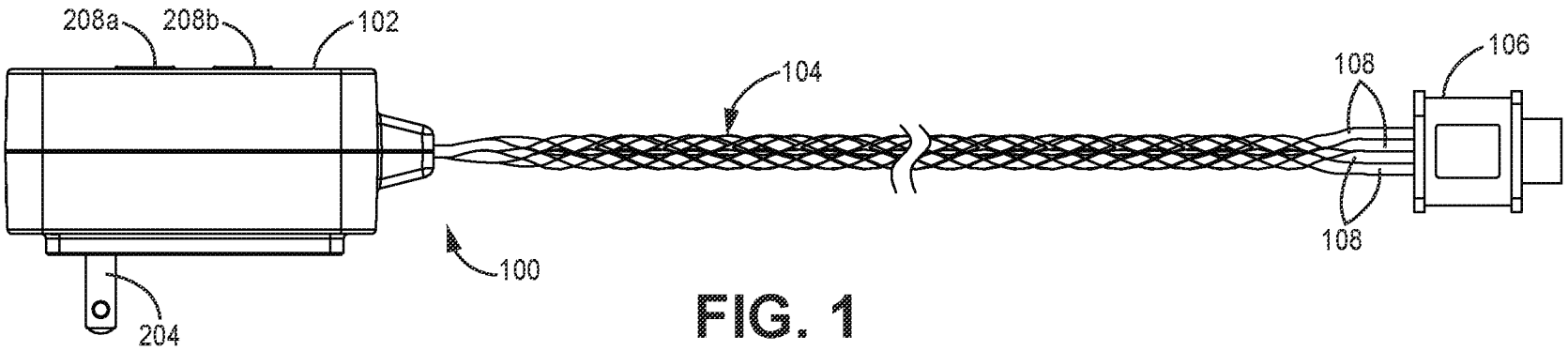
FIG. 1 is a front view of a pre-lit tree controller, according to an embodiment.
Figure 8:
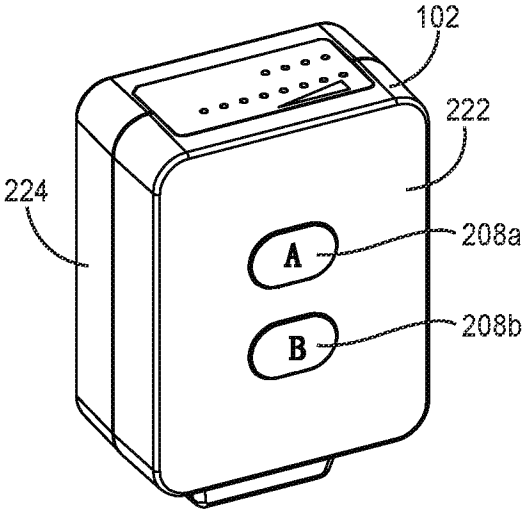
FIG. 8 is a front perspective view of a controller-timer, according to an embodiment.
Figure 9:
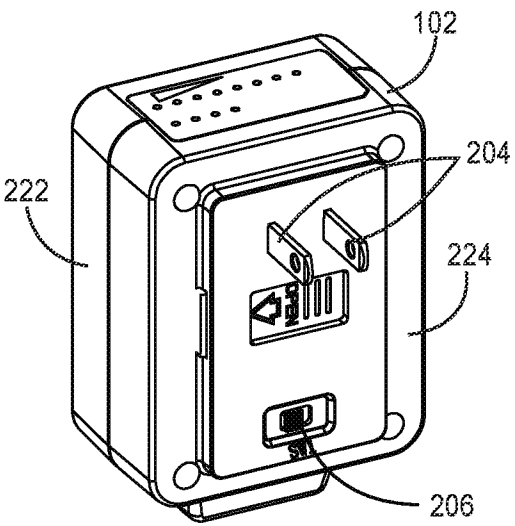
FIG. 9 is a rear perspective view of the controller-timer of FIG. 8.

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION OF THE FIGURES

Referring to FIG. 1, an embodiment of a pre-lit tree controller 100 is depicted. In the embodiment depicted, pre-lit tree controller 100 includes controller-timer 102, wire bundle 104 and trunk connector 106 is depicted. Although the depicted embodiment of controller 100 is configured to mechanically and electrically connect to an artificial tree so as to control light elements of the artificial tree, it will be understood that other embodiments of controller 100 may be configured to connect to, and operate with, other types of decorative lighting and decorative lighting applications, such as light strings, net lights, icicle lights, and so on.

As depicted, wire bundle 104 includes a plurality of wires 108, each wire comprising an insulated conductor. In the embodiment depicted, wire bundle 104 includes four wires 108 connected to controller-timer 102. In other embodiments, wire bundle 104 may include more of fewer wires 108 depending on one or more considerations, such as functions of controller-timer 102, number and type of light elements controlled, tree design and so on.

Connector 106 receives wires 108 such that connector 106 is in electrically connected to controller-timer 102. As described further below, connector 106 may include multiple conductive electrical terminals. In an embodiment, each wire 108 is electrically connected to one of the multiple electrical terminals of connector 106. In on such embodiment, connector 106 includes four terminals connected to four wires 108 (as depicted); in another embodiment, connector 106 includes two terminals connected to two wires 108; in yet another embodiment, connector 106 includes six terminals connected to six wires 108.

Figure 2:
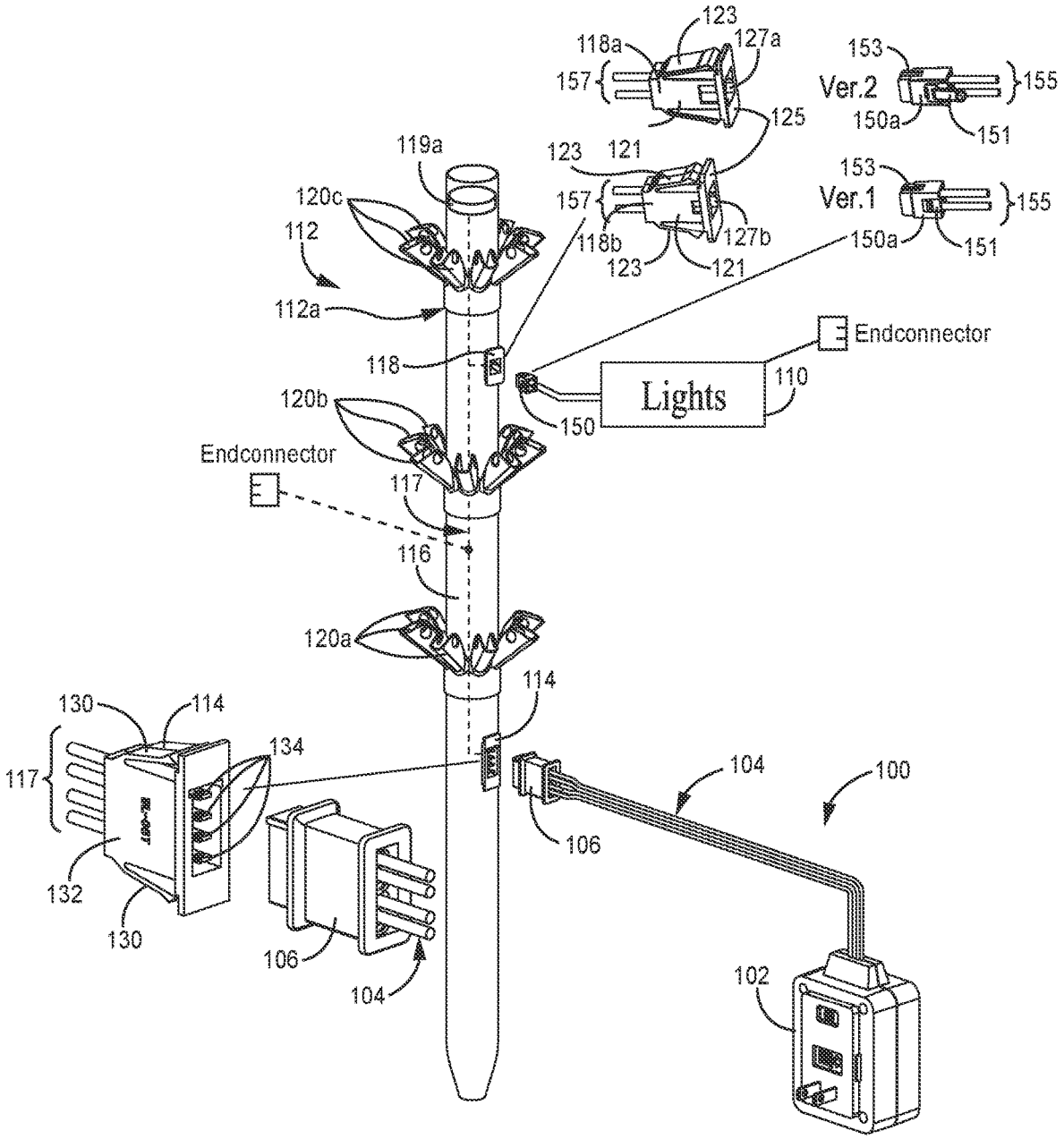
FIG. 2 is a perspective view of a pre-lit tree, according to an embodiment.

Referring also to FIG. 2, in the embodiment depicted, controller-timer 102 comprises a controller that selectively controls light elements or lights of a light network 110 of an artificial tree 112, also referred to herein as a "pre-lit tree", such as pre-lit tree 112, to create various lighting effects.

Referring to FIGS. 2-7, an embodiment of the disclosure includes pre-lit tree 112. In an embodiment, pre-lit tree 112 comprises pre-lit tree controller 100, controller connector 114, trunk portion 116, trunk wires 117, light connector 118, trunk connector 119, branch supports 120, branches 122, and light network 110. In an embodiment, and as depicted, branch supports 120 may comprise a plurality of sets of branch supports 120, each set having individual branches supports 120 being distributed uniformly about a circumference of trunk portion 116 at a particular point along a length of trunk portion 116. Three sets of branch supports 120 are depicted in FIG. 2, comprising a set "a" of branch supports 120*a*, set b of branch supports 120*b*, and a set c of branch supports 120*c*. In an embodiment, lights 110 may be distributed about and on branches 122. As described further below, in an embodiment, light network 110 comprises light-wiring network 124 with light strings 126 having light elements 128.

Referring specifically to FIG. 2, only a single section of tree 112 is depicted, first tree section 112*a*. However, it will be understood that pre-lit tree 112 may include a single tree section, such as tree section 112*a* only, or may include a plurality of tree sections. In an embodiment, pre-lit tree 112 includes two tree sections, such as first tree section 112*a*, and a second tree section that mechanically and electrically couples with first tree section 112*a*. In another embodiment, pre-lit tree 112 includes three tree sections, a first tree section, which may be a lower tree section, a second tree section, which may be a middle tree section, and third tree section, which may be an upper tree section. Other embodiments may include four or more tree sections. The various tree sections are configured to mechanically couple to each other such that the tree sections are aligned along a central vertical axis.

One or more of the tree sections are configured to also electrically couple to one another via trunk connectors, such as connector 119*a* of first tree section 112*a*, which may be configured to electrically connect to a corresponding electrical connector of a second tree section, and so on. Embodiments of lighted artificial trees, or pre-lit trees that include multiple tree sections or portions, each tree section electrically and mechanically connecting to another tree section, are described in: U.S. Pat. No. 8,454,186, entitled Modular Lighted Tree with Trunk Electrical Connectors; U.S. Pat. No. 9,677,749, entitled Conformal Power Adapter for Lighted Artificial Tree; U.S. Pat. No. 8,876,321, entitled Modular Lighted Artificial Tree; and U.S. Pat. No. 9,044,056, entitled Modular Tree with Electrical Connector, all of which are incorporated by reference herein in their entireties.

In an embodiment, trunk connector 119*a* (FIG. 1) may be located within trunk portion 116, but in other embodiments, may be located external to, or on an exterior of, trunk portion 116, though still connectable to a trunk connector of another tree section. In an embodiment, additional tree sections, such as second or third tree sections may be substantially the same as tree section 112*a*, though in an embodiment, the additional tree sections may not include an additional controller 100 with connector 114, but rather, a single controller 100 may be used to control and time powering of lights throughout the entire tree 112 and is multiple tree sections.

In an embodiment, trunk portion 116 of tree section 112*a* comprises a generally cylindrical, hollow tube such that power and control wires 117 may extend within trunk portion 116 from connector 114 to connector 118 so as to transmit power and in some embodiments, communication signals, from pre-lit tree controller 100 to connector 118 and light network 110. As depicted, wires 117 extend within trunk portion 116, but it will be understood that in other embodiments, wires 117 may extend from connector 114 to connector 118 outside of trunk portion 116, may extend partially inside and partially outside of trunk portion 116.

Further, in an embodiment wherein pre-lit tree 112 includes multiple tree sections, wires 117 may also electrically connect trunk connector 119*a* to controller 100, such that controller 100 is in electrical connection and communication with the other tree sections and other light networks of pre-lit tree 112.

In an embodiment, controller connector 114 includes a pair of flexible arms 130, body portion 132, a plurality of conductive electrical terminals 134, and flanged face portion 136. Body portion 132 defines receiving portion 140. In an embodiment, terminals 134 are located within receiving portion 140, as depicted. In another embodiment, terminals 134 extend outside of body portion 132.

Figures 3A, 3B:
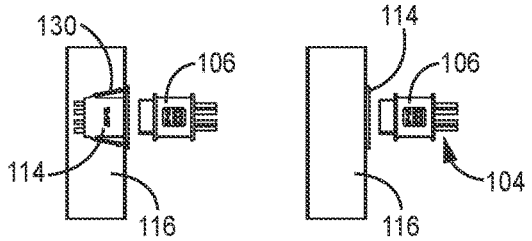
FIG. 3A is a partial sectional view of a trunk of the pre-lit tree of FIG. 2 with a pair of connectors.
FIG. 3B is a front view of a portion of the trunk and connectors of the pre-lit tree of FIG. 2.

Referring also to FIG. 3A, which depicts connector 114 positioned onto trunk portion 116 in a partial cutaway, and FIG. 3B, which depicts connector 114 positioned onto trunk portion 116, without trunk portion 116 in cutaway, body portion 132 and arms 130 may be inserted and fit into an opening in trunk portion 116. Flexible arms pivot about a connection point on body 132, bending inward toward body portion 132 upon insertion into trunk portion 116, forming a snap fit with trunk portion 116, so that connector 113 cannot easily be removed from trunk portion 116. As such, assembly of connector 114 to trunk portion 116 is simple and quick, and provides a useful locking feature that prevents a user from removing connector 114 after tree assembly, and potentially exposing wires transmitting power.

Two embodiments of light-string connector 118 are depicted in FIG. 2, connector 118*a* and connector 118*b*. Both connectors 118*a* and 118*b* are similar, and in an embodiment, each include body portion 121, flexible arms 123 for forming a snap fit into trunk portion 116, and flanged face portion 125. Body portion 121 of connector 118*a* defines a receiving portion 127*a* configured to receive a corresponding light network 110 connector 150*a*, while body portion 121 of connector 118*b* defines a different receiving portion 127*b*, configured to receive a corresponding light network connector 110 connector 150*b*. In an embodiment, connectors 118 comprise female connectors, and connectors 150 comprise male connectors.

In an embodiment, body portion 121 may also include one or more locking-tab-receiving apertures for receiving a locking tab 151 of connector 150. In the embodiment of connector 150*a*, locking tab 151 may include a lever portion that may be pressed to unlock connector 150*a* from connector 118*a* after insertion. In an embodiment, connector 150*b* is also releasably locked, but not as conveniently unlocked from connector 118*b* due to the shorter profile and accessibility of the locking tab.

Connectors 150, in an embodiment, include multiple conductive electrical terminals 153 connected to wires 155, terminals 153 being configured to electrically connect to conductive electrical terminals of connector 118, which are electrically connected to wires 157, thereby making an electrical connection between wires 153 and 157. Wires 157 may comprise a portion of wires 117, and are in electrical connection with pre-lit tree controller 100.

Figure 4:
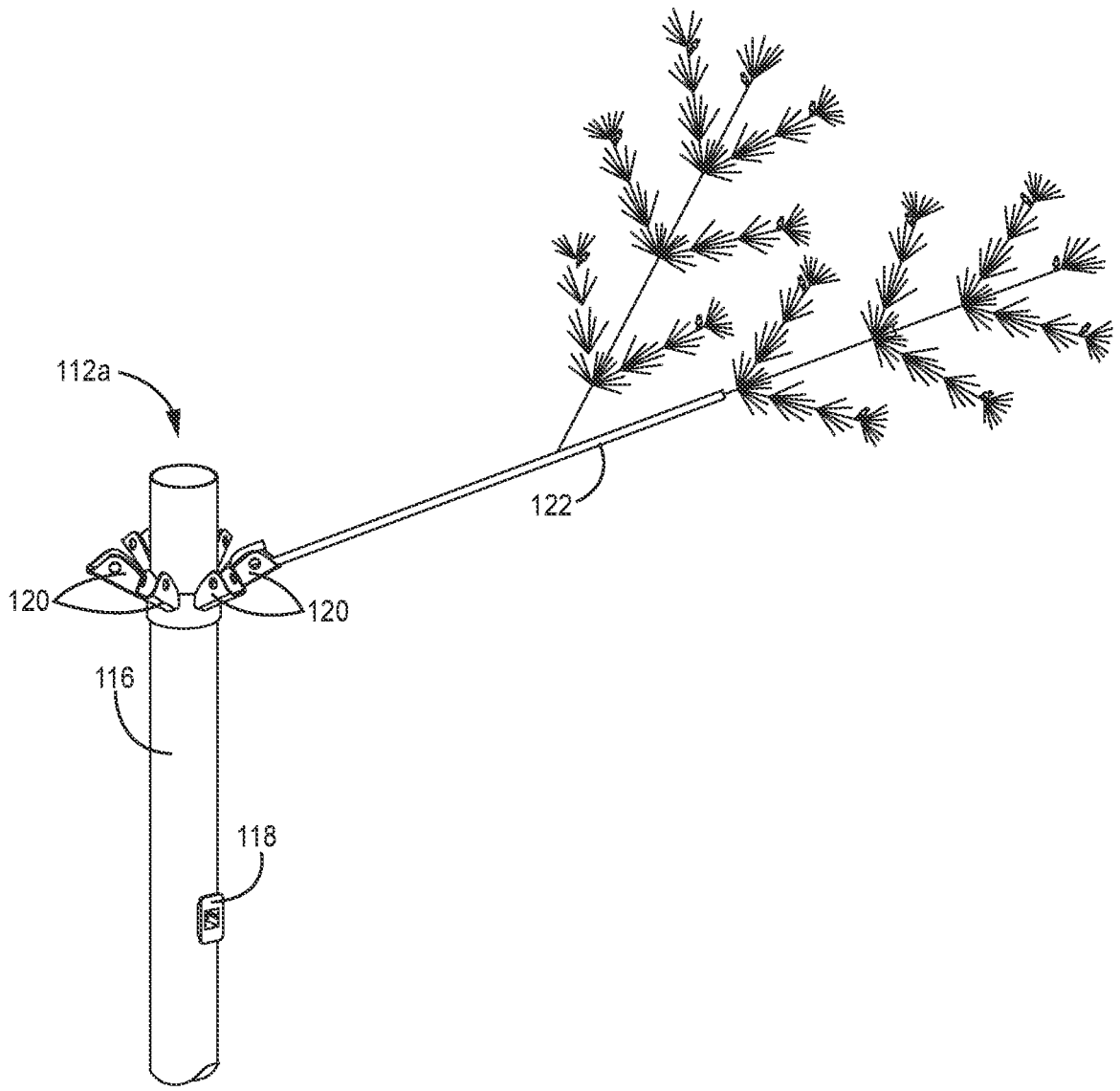
FIG. 4 is perspective view of a portion the pre-lit tree of FIG. 2, depicting a trunk with branch supports, branch, and a connector.

Referring to FIG. 4, a partial portion of tree section 112*a*, which may be a top portion, is depicted. Branch supports 120 are coupled to trunk portion 116, light connector 118 is fit into trunk portion 116, and branches 122 (only one depicted) are pivotally connected to branch supports 120.

Figure 5:
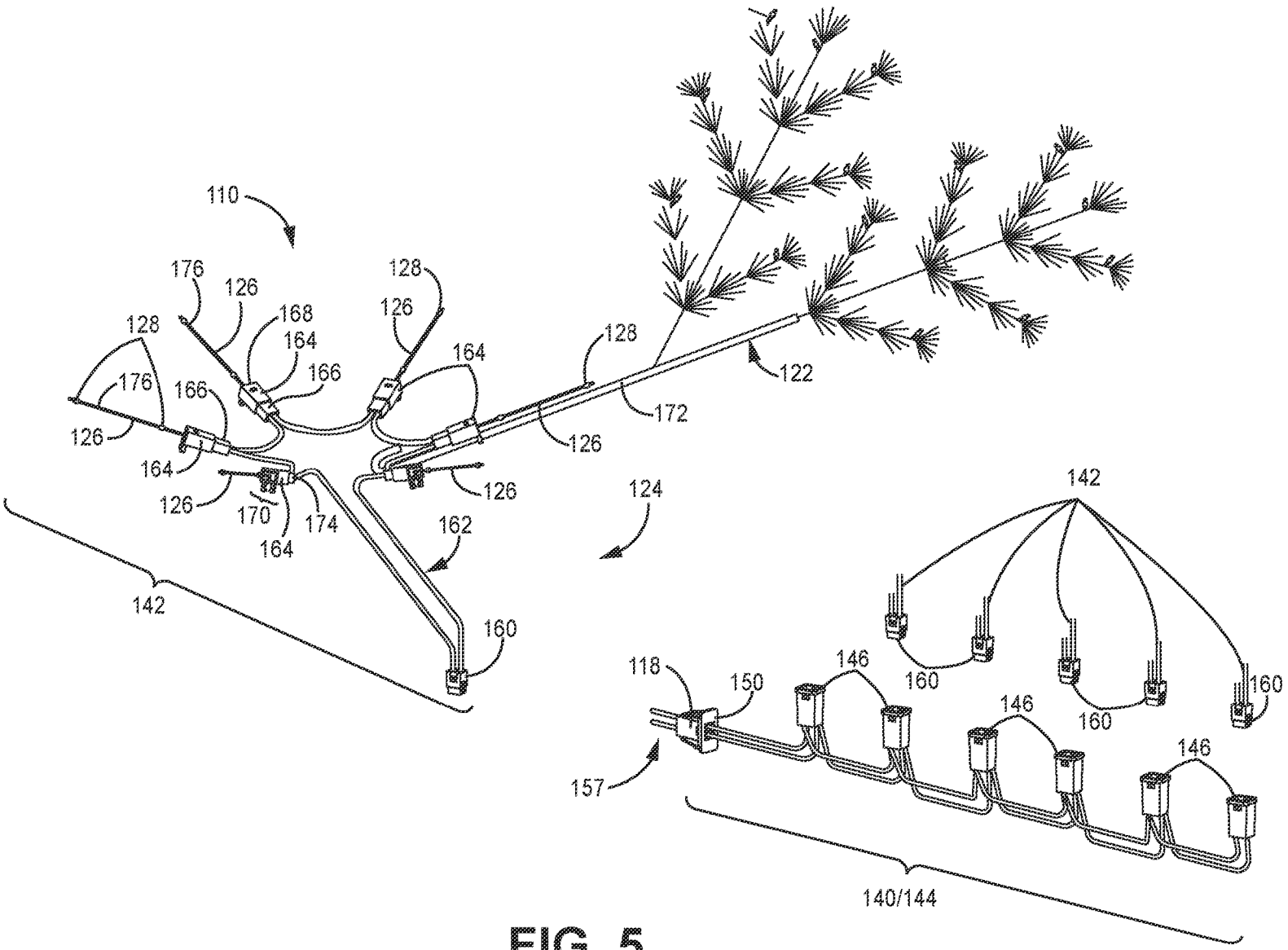
FIG. 5 is an exploded view of a light network, according to an embodiment.

Referring to FIG. 5, an embodiment of light network 110 with a branch 122 is depicted. In an embodiment, light network 100 includes light-wiring network 124 with light strings 126 that include individual light elements 128.

Figure 6:
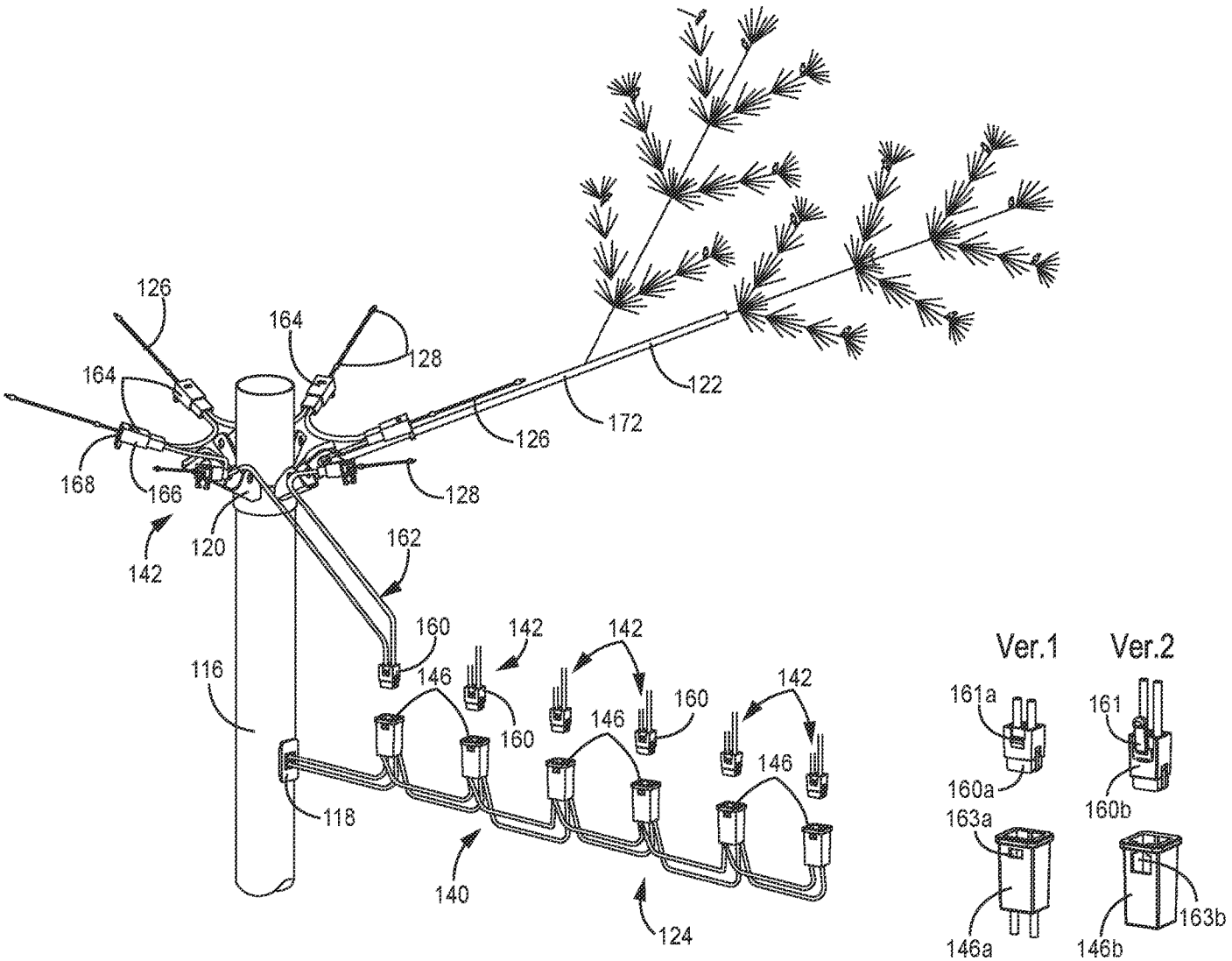
FIG. 6 is perspective view of the portion of the pre-lit tree according to FIG. 4 with the light network of FIG. 5.

Referring also to FIG. 6, in an embodiment, light-wiring network 124 includes a plurality of wires and connectors. More specifically, in an embodiment, light-wiring network 124 includes tree-section wiring assembly 140 and a plurality of branch-level wiring assemblies 142.

In an embodiment, tree-section wiring 140 includes connector 150, which in an embodiment comprises a male connector and is configured to be connected to, and received by a connector 118. Tree-section wiring 140, in an embodiment also includes tree-section wiring 144, and a plurality of branch-level connectors 146 electrically and mechanically connected to tree-section wiring 144. Tree section wiring 144 is electrically connected to connector 150 and its electrical terminals, and when connector 150 is plugged into, or received by connector 118, an electrical connection between wires 157 and wiring 144 is made, such that power and communication signals send from pre-lit tree controller 100 are transmitted via wiring 144 to each of connectors 146, and as described further below, to each wiring assembly 142 and its respective light strings 126.

As depicted, connectors 146 are electrically connected in parallel, though in other embodiments, may be electrically connected in series or in a series-parallel connection.

For the sake of simplicity, only one branch-level wiring assembly 142 is depicted in full. However, it will be understood, that in an embodiment, each tree section of pre-lit tree 112 may include a plurality of branch-level wiring assemblies 142. In one such embodiment, a tree section includes one branch-level wiring assembly 142 for each set of branch supports 120 and set of branches 122 located at a particular location, or "level" of trunk portion 116.

Figure 7:
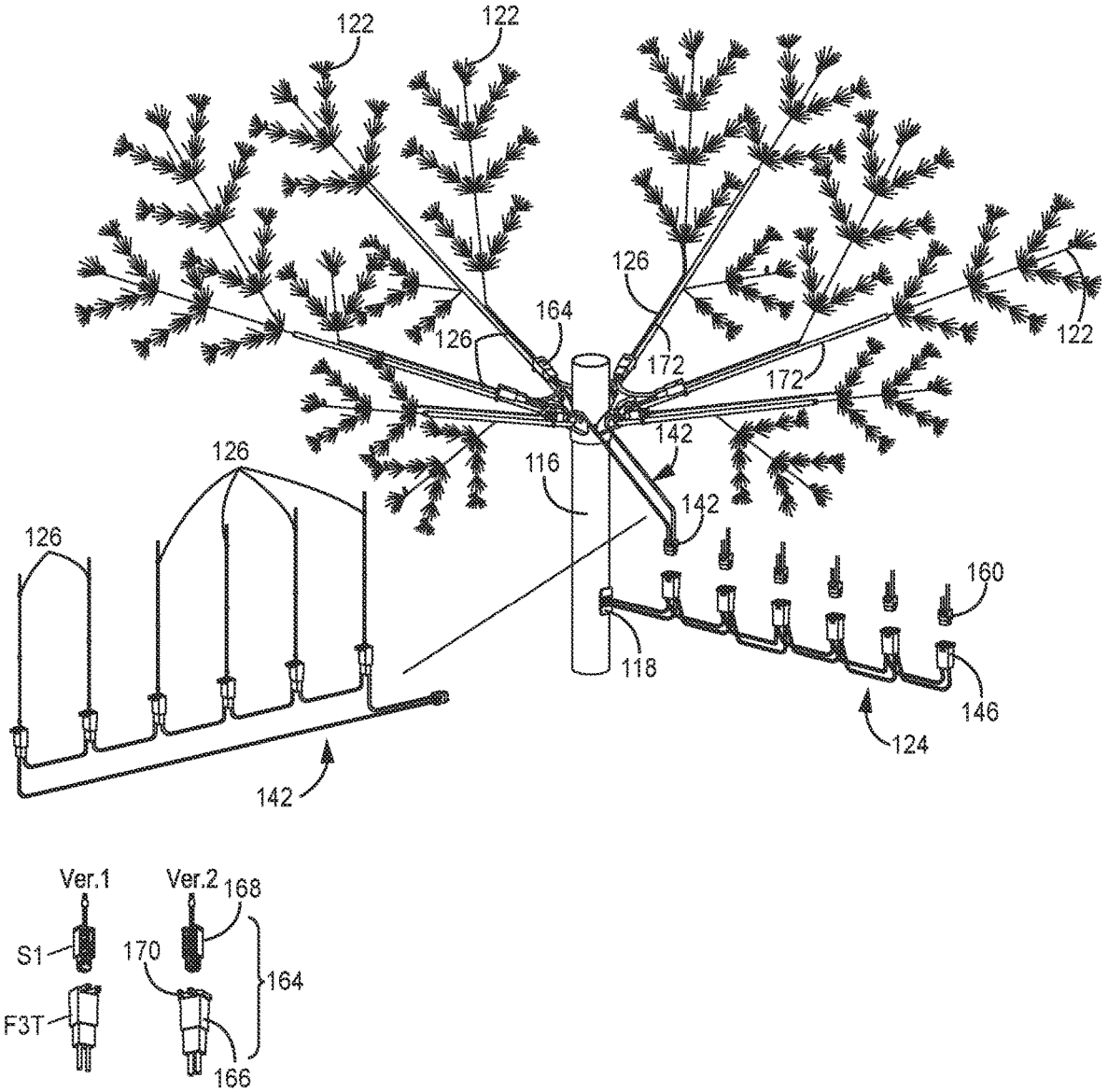
FIG. 7 is another perspective view of the portion of the pre-lit tree of FIG. 6, with additional branches and light network detail.
Figure 10A:
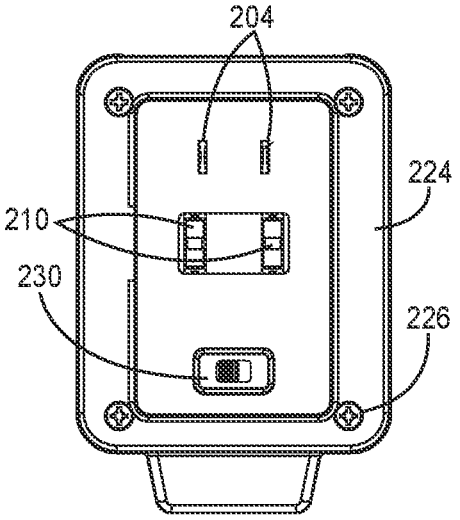
FIG. 10A is a rear view of the controller-timer of FIG. 8, in an embodiment that includes two fuses.
Figure 10B:
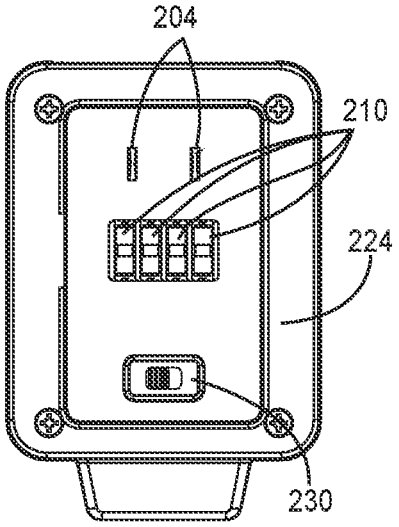
FIG. 10B is a rear view of the controller-timer of FIG. 8, in an embodiment that includes four fuses.
Figure 12:
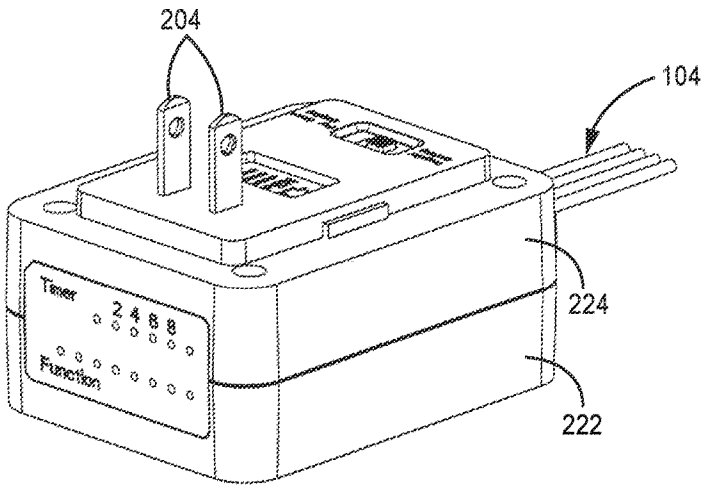
FIG. 12 is a right-side perspective view of the controller-timer of FIG. 8.
Figure 11:
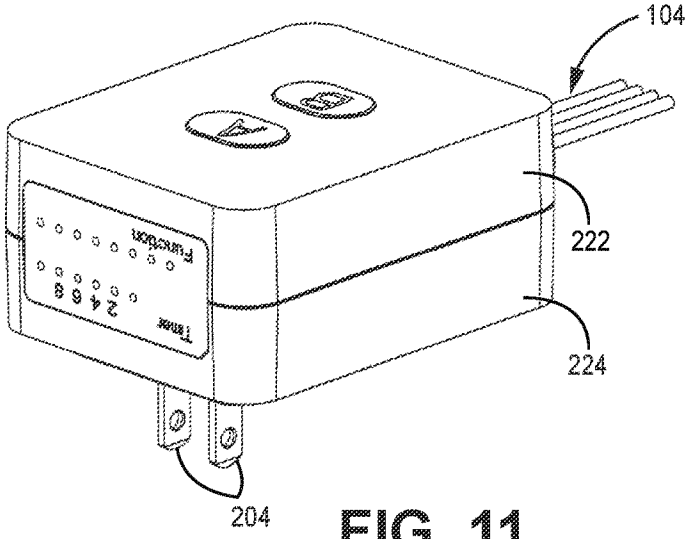
FIG. 11 is a left-side perspective view of the controller-timer of FIG. 8.
Figure 13:
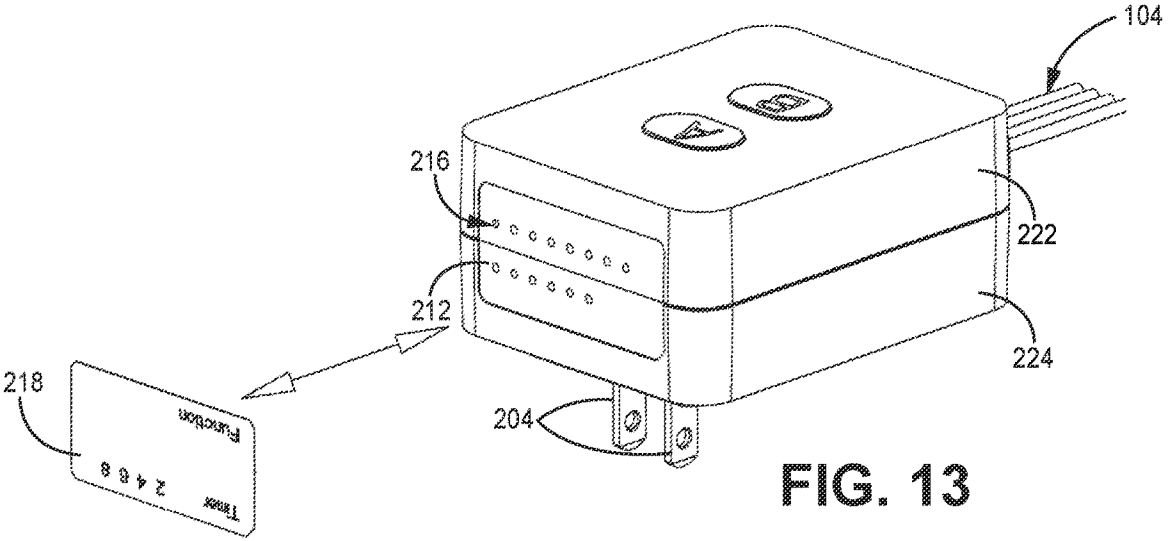
FIG. 13 is a left-side, partially exploded perspective view of the controller-timer of FIG. 8, with a film of function indicia.

Referring to FIGS. 5-7, in an embodiment, each branch-level wiring assembly 142 includes branch-level connector 160, branch-level wiring 162, light string connectors 164, and light string assemblies 126.

Two different branch-level connectors 160 are depicted, connector 160*a* and 160*b*, configured to mechanically couple and electrically connect to connectors 146*a* and 146*b*, respectively. Connectors 160*a* and 160*b* are substantially similar, with some differences in the way that their respective locking tabs 161 fit into their respective lock apertures 163. Connector 160*b* includes a locking tab 161*b* with a lever that can be used to more-easily release connector 160*b* from connector 146*b* by an end user activating the lever, as opposed to requiring a tool to release the locking mechanism formed by connectors 160*a* and 146*a*.

As depicted, branch-level wiring 162 electrically connects connector 160 to each of light string connectors 164. As depicted, light string connectors 164 are electrically connected to one another in a series configuration, though in other embodiments, all light string connectors 164 of a particular branch-level wiring assembly 142 may be electrically connected to one another in parallel, or in another embodiments, connectors 164 may be electrically connected to one another in a series-parallel configuration.

Light-string connectors 164 may comprise various structures, and in an embodiment, include first portion 166 connected to wiring 162 and a second portion 168 connected to wires of a light string 126. In an embodiment, first portion 166 may include a plurality of conductive electrical terminals (not shown) that electrically connect to the conductors of wiring 162, and second portion 168 may also include a plurality of conductive electrical terminals (not shown) that electrically connect to the conductors of a light string 126. When first portion 166 is coupled to second portion 168, an electrical connection between a light string 126 and branch-level wiring 162 is made. As such, each light string 126 is in electrical connection with pre-lit tree controller 100, and thereby controlled by controller 100 in operation.

In an embodiment, each light string connector connects a relatively large-diameter wire 162 of a branch-level wiring network 142 to a relatively small-diameter wire of light string 126.

In an embodiment, light string connector 164 may also include branch-connecting portion 170. Branch-connecting portion 170, in an embodiment, includes a pair of opposing arms configured to grasp or receive a portion of a branch 122, such as a shaft portion 172, thereby coupling a connector 164 to a branch 122. In an embodiment, when light string connector 164 is connected to shaft portion 172, an end opening 174 faces a direction that is parallel to a shaft portion 172 such that connector 164 and light string 126 are "pointed" in a direction parallel to, or aligned with, branch shaft portion 172 when light string 126 is connected to connector 164. In such a configuration, wires 176 of light string 126 immediately extend parallel to branch shaft 172, such that wires 176 are not bent at or near connector 164. Avoiding bending wires 176 may be beneficial when light string wires 176 comprise small gauge or single-strand conductors.

In an embodiment, the number of connectors 164 and light strings 126 matches the number of branch supports 120 in a set of branch supports at a particular trunk level, and the number of branches 122, such that there is one light string per branch. As depicted, a set of branch supports 120 includes six branch supports 120 and six branches 122 (only one branch 122 depicted). In an embodiment, for a given tree section 112*a*, the number of branch supports 120 in a set, and therefore the number of connectors 164 and light strings 126 per branch level, is the same for each set of branch supports. In other words, in the depicted embodiment, for example, each set of branch supports always has six branch supports 120, six branches 122, and six light strings 126. In other embodiments, the number of branch supports 120, branches 122, and light strings 126 may be greater or fewer for a particular branch level. In other words, for example, a set of branches below or above the depicted set having six light strings may have eight or four branch supports 120, branches 122 and light strings 126. In an embodiment, all branch levels or sets of branch supports, branches and light strings at a particular branch level of the trunk portion 116, or position on the trunk portion 116 is the same for any particular tree sections, but each tree section may have a different number of supports, branches and light strings. In one such example, a lower tree section 112*a* has six branch supports 120, six branches 122, and six light strings 126 per branch level for all branch levels, however, a middle tree section or upper tree section may have four branch supports 120, four branches 122 and four light strings per branch level.

When light strings 126 of a light-wiring assembly 142 are connected in parallel (not depicted), the number of light strings 126 per branch level can vary from branch level to branch level without consequence, because connector 160 delivers a voltage that is applied to all light strings 126. In one such embodiment, each connector 160 supplies 3 VDC to each connector 164 and each light string 126.

However, when light strings 126 are connected in series, such as is depicted, the number of light strings 126 per branch level need be considered. In the embodiment depicted, a DC voltage is delivered via connector 100 to each connector 146, and therefore to each light-wiring network 142. In the depicted embodiment, there are six light strings 126 per branch level, or per wiring network 142. The six light strings 126 are electrically connected in series in the depicted embodiment, such that each light string receives $1/6^{th}$ of the voltage at connector 146. In one embodiment, controller 100 provides 18 VDC to each connector 146, such that each light string 126 receives 3 VDC. If each wiring assembly 124 and each branch level includes the same number of light strings 126, then each light string 126 receives the same voltage, e.g., 3 VDC.

However, if a different number of light strings 126 are applied to one branch level as compared to another, e.g., six light strings 126 at one level, and four light strings at another level, while still delivering the same 18 VDC voltage, then light strings 126 at one level would receive 3 VDC each (18 VDC divided by 6 light strings), and light strings at another level would receive 4.5 VDC (18 VDC divided by 4 light strings). To avoid such a situation, and thereby avoid having to configure light strings to operate on different voltages, a load resistor may be added in series to the light strings such that an appropriate voltage may be applied to each light string. Continuing with the embodiment described, a set of six light strings 126 may be connected in series with one another and each receive 3 VDC without the use of a load resistor, and a set of four light strings may be connected in series with each other and with one or more resistors, the one or more resistors selected to drop 6 VDC so that each of the four light strings 126 of the set receives 3 VDC, and light strings 126 having the same operating voltage may be used throughout tree 112.

In an embodiment, it may be useful to have more branches and light strings per branch level for lower branches, e.g., eight or six, as compared to higher branches, e.g., six or four, to provide tree 112 with a more natural look.

In an embodiment, each light string 126 may comprise a set of parallel conductors of wires 176 and a plurality of light elements 128 electrically connected in parallel. In an embodiment, light elements 128 may comprise LEDs.

In an embodiment, light strings 126 may be manufactured from a very long, continuous set of lights comprising a pair of single-strand or multi-strand conductors and LEDs. In such an embodiment, the spacing between LEDs is uniform, and portions of the continuous light set are cut to a desired length or LED count from the longer, continuous set of lights as part of the manufacturing process. In an embodiment, the conductors of light strings 126 are insulated, such as with a PVC insulation.

In an embodiment, wires and conductors of light strings 126 may comprise a relatively small diameter size or wire gauge as compared to a diameter size of branch-level wires 162. In an embodiment, wires of branch-level wiring 162 may comprise 25 AWG wires or larger diameter, including 22 AWG wires, while wires of light strings 126 may comprise wires that are smaller than 25 AWG, such as 26 AWG, 28 AWG, or 30 AWG. Other smaller sizes may be used for light string 126 wires.

As described further below, pre-lit tree controller 100 selectively powers and may communicate with light strings 126 to create lighting effects, and to time when light strings 126 will be powered on or off via a timing function. Such lighting effects may include simple on-off control, brightness control, fading, flashing, sequential powering, color selection or changing, and other lighting effects. In an embodiment, controller-timer 102 also includes a "timer" function, which provides timing control. Timing control may be applied to not only light elements of the pre-lit tree, but also to an accessory power receptacle which may provide AC power to another device other than a light string 126.

Features of pre-lit tree controller 100 and controller-timer 102 are described further below, starting with a detailed description of the mechanical features, followed by a detailed description of electrical features of several embodiments of controller 100 and controller-timer 102.

Referring to FIGS. 8-13, various views of assembled controller-timer 102 are depicted.

Referring also and specifically to FIGS. 1-2, in an embodiment, and as depicted, controller-timer 102 includes enclosure 200, one or more printed circuit boards with electronics (PCBs), source-power terminals 204, optional store-home switch 206, one or more user-input switches 208 (push-button switches 208*a* and 208*b* depicted), one or more fuses 210, timer setting indicators 212 (e.g., LEDs), light function indicators 216 (e.g., LEDs), and indicia 218 (depicted as "Timer", "Function", and numbers 2, 4, 6, and 8 indicating hours or time intervals).

In an embodiment, and as depicted, enclosure 200 forms a rectangular cuboid, though enclosure 200 may form other shapes, and in an embodiment comprises a non-conductive plastic material. In an embodiment, enclosure 200 includes first portion 222 and second portion 224, which may be held together by fasteners 226, or by other means, including adhesives, or by means of mechanical fitments of the two portions, including snap fit, friction fit, and so on.

First portion 222, which may comprise a front portion, in an embodiment, includes switch covers, depicted as A and B, for user-input switches 208, including switches 208*a* and 208*b*. In an embodiment, switch covers A and B may comprise buttons to be pushed by a user so as to activate switches 208*a* and 208*b*, which in an embodiment, are used to select timer and light effect functions, as described further below. First portion 222 also includes internal walls and other mechanical structures to support PCBs, switches 208, and other controller hardware, as depicted.

Second portion 224, which in an embodiment may comprise a rear portion of enclosure 200, includes switch cover 230, fuse cover 232 and fuse enclosure 234. Second portion 224 is configured to couple to first portion 222.

Printed circuit boards include various electrical components as described further below, including one or more processors or microcontrollers, memory, switches, power-conditioning components and other such components.

Source-terminals 204, in an embodiment, comprise conductive electrical terminals, such as the "blade" terminals depicted, and are configured to be received by, and connected to, an external power source, such as, but not limited to, a power outlet providing alternating-current (AC) power.

Optional switch 206, when present, and in an embodiment, is configured to allow a user to switch between multiple primary settings. In an embodiment, a first setting, which may be a setting utilized by retailers, causes controller-timer 102 to default to a single standard timer and function setting after a predetermined period of time. In such an embodiment, if a user is operating buttons A and B to change timer and function settings, after the predetermined period of time, controller-timer 102 will revert to a default setting. Such a default setting might be one that is determined to be most beneficial for the sale of the product in a retail store environment. In an embodiment, such a default or store setting might include a setting where the controller-timer 102 setting includes a power-on setting, and a predetermined light-effect function, such as a color-changing effect, e.g., fading in and out from red to green.

In a regular setting, operation of buttons A and B will simply facilitate selection and operation of the selected functions, without reverting back to a default setting.

Input switches 208 may comprise push-button switches as depicted and described below, though it will be understood that other types of switches may be used.

Fuses 210, in an embodiment, are connected in line with terminals 204 to provide overcurrent protection.

Timer setting indicators 212, in an embodiment, and as depicted, comprise a series of LEDs. In an embodiment, each LED corresponds to a predetermined period of time; the predetermined period of time may be a duration of time during which controller-timer 102 outputs power and control signals. In an embodiment, when a particular LED is lit, it indicates that a particular duration has been selected. In the depicted embodiment, indicia 218 indicate time duration options, which may be in hours, e.g., 2 hours.

Function indicators 216, in an embodiment, and as depicted, comprise LEDs. In an embodiment, each LED corresponds to a particular function, and lighting of the LED indicates that the particular function has been selected.

As described further below, in operation, button A may correspond to timer functions, and button B may correspond to light functions. In an embodiment, pushing and holding button A, corresponding to switch 208*a*, turns controller-timer 102 on and off, while pressing and holder button A cycles through the various time duration options available. In an embodiment, initially holding button A, followed by releasing button A when the selected indicator LED 212 is lighted, will select the time duration corresponding to that indicator LED 212 as indicated by indicia 218.

In an embodiment, pressing and releasing button B will control brightness and various light effect functions.

As described in part above, pre-lit tree controller 100 with controller-timer 102, and controller-timer 102 as applied to other non-tree decorative lighting applications, may include a number of features, including: brightness adjustment; selectable timer durations; remote control, including radio-frequency (RF) remote control; end connector (AC accessory receptacle) on/off control; store/display setting; color-changing; and various light effect functions, including flashing, chasing, fade in and out, twinkling and so on (often referred to as "8-function" control). Embodiments of the disclosure include various combinations of the above features.

Table 1 describes five different embodiments:

TABLE 1

| | Output type | End connector | Fuse | Functions | Light-type |
|---|---|---|---|---|---|
| 120 V + LV(SP) | DC 12 2 A | AC 120 V 3 A | Fuse × 2 pcs | Brightness adjustment<br>Timer 2/4/6/8/10/12<br>RF Remote control<br>End Connector ON/OFF<br>Display switch | Single-polarity LED lamp string<br>Low Voltage 12 V |
| 120 V + LV(DP) | DC 12 2 A | AC 120 V 3 A | Fuse × 2 pcs | 8 Function<br>Color change<br>Timer 2/4/6/8<br>RF Remove control<br>Display switch | Double polarity LED lamp string<br>Low Voltage 12 V |

TABLE 1-continued

| | Output type | End connector | Fuse | Functions | Light-type |
|---|---|---|---|---|---|
| 120 V + LV(DP) | DC 12 2 A | AC 120 V 3 A | Fuse × 2 pcs | Drive 64 Hz Forward and reverse<br>Timer 2/4/6/8<br>RF Remote control<br>Display switch | Double polarity LED lamp string<br>>6400 pcs LED (>24 W Led string)<br>Low Voltage 12 V |
| 120 V + 120 V(SP) | AC 120 V 1 A | AC 120 V 3 A | Fuse × 4 pcs | Brightness adjustment<br>Timer 2/4/6/8<br>RF Remove control<br>Display switch | Single-polarity LED lamp string<br>AC 120 V |
| 120 V + 120 V(DP) | AC 120 V 1 A | AC 120 V 3 A | Fuse × 4 pcs | 8 Function<br>Color change<br>Timer 2/4/6/8<br>RF Remote control<br>Display switch | Double polarity LED lamp string<br>AC 120 V |

In Table 1 above, low voltage is abbreviated as "L.V.", double polarity is abbreviated as "DP", single polarity is abbreviated as "SP".

While embodiments include more than the five exemplary embodiments of Table 1, the five above embodiments will be further described below. The five embodiments will be referred to as Embodiments 1 to 5, corresponding to the respective first (top) through fifth row (bottom row) of Table 1.

Each of Embodiments 1-5 provide and control AC power to an end connector (power receptacle) and provide either AC or DC power to light network 110 and its light elements.

In Embodiment 1 of controller-timer 1-2, input voltage is 120 VAC, output voltage to an end connector is 120 VAC (3 amp maximum rating, in an embodiment), and output to a light network 110 is 12 VDC (2 A maximum rating, in an embodiment). Two fuses 210 are included. Light strings include LED light elements 328 and are "single polarity" in that the light string is provided with only a forward or reverse voltage, and is not intended to be switched back and forth, such as might be the case for light elements 328 that include multiple LEDs configured in opposite polarities. In this version of Embodiment 1, functions include brightness adjustment, selectable timer durations, RF remote control, and end connector that can be selectively powered on and off, and an optional display (store) switch.

Figure 14:
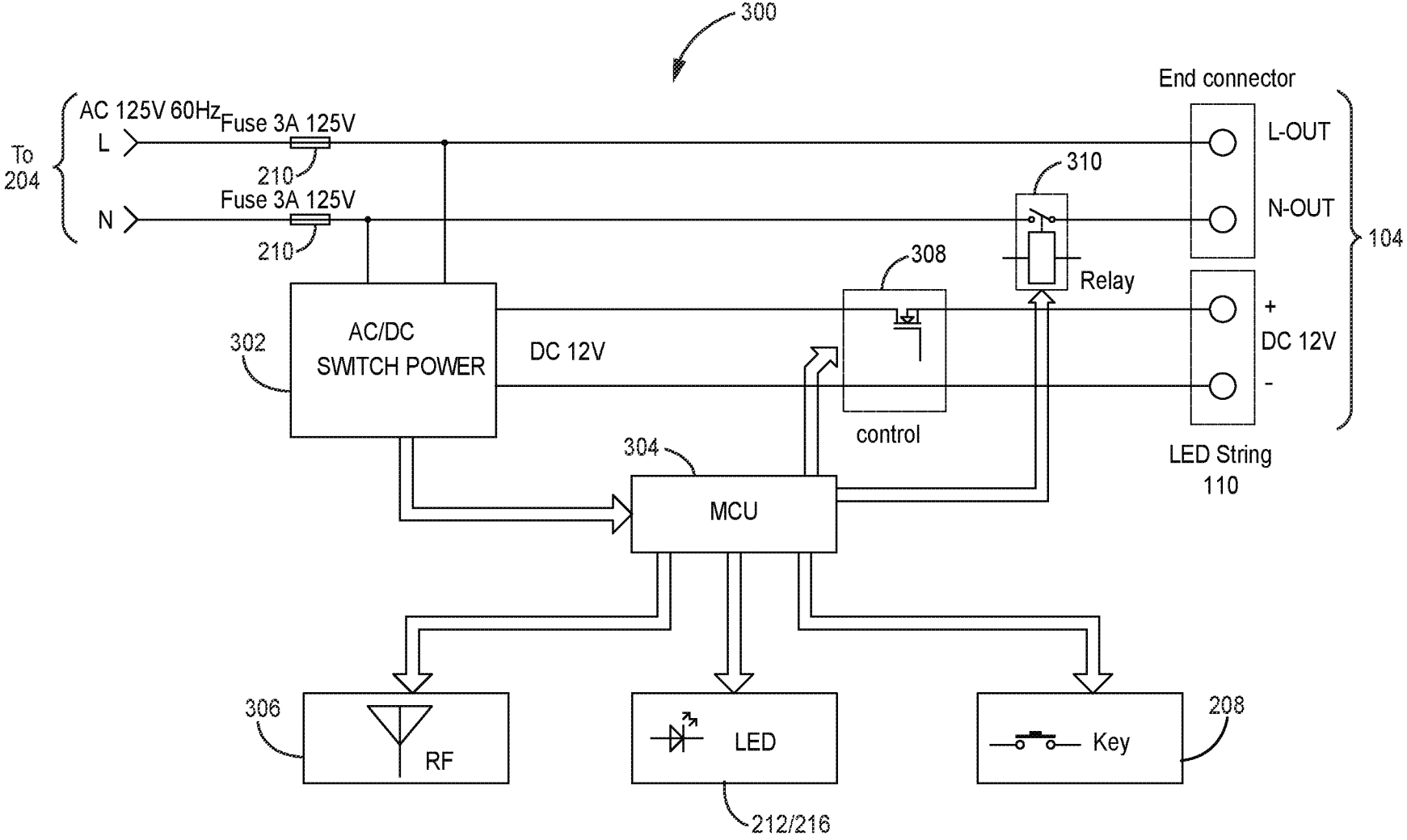
FIG. 14 is a block diagram of a power and control circuit of a controller-timer for DC lights and an AC power receptacle, according to an embodiment.

Referring to FIG. 14, an electrical block diagram of a power and control circuit 300 of Embodiment 1 of controller-timer 102 is depicted. In an embodiment, circuit 300 includes a pair of fuses 210 at incoming power lines L and N, power conditioning circuitry 302, microcontroller unit (MCU) 304, RF circuit 306, indicator LEDs 212 and 216, input switches 208, switching control circuit 308, relay or switch 310, AC power out lines L (line/live/hot) and N (neutral) for an end connector, and + and – lines or terminals for DC power out to a light network 110.

In operation, power is received by incoming lines L and N, and is conditioned and converted from AC power to DC power for use by MCU 304. Optional RF circuit 306 is in electrical communication with MCU 304, and may receive input from an RF remote control device operated by a user, said input being transmitted to MCU 304 for processing. MCU 304 is in communication with switches 208, which are operated by a user. Activation of the switches, which may be momentary push button switches, are recognized by MCU 304, which may include software or firmware saved in a memory unit. In an embodiment, MCU 304 is configured to retain a control or function setting in memory after power to a light network 110 is turned off due to expiration of a selected predetermined time duration via the timer function.

MCU 304, based on inputs from a user, selectively controls relay 310 to turn AC power for an end connector on and off, and independently and selectively controls control circuit 308 to deliver power, which may include data, in the form of low voltage DC output power to a light network 110. Unlike typical decorative lighting controllers, control system 300 controls both a light network, such as light network 110, and AC power to a power receptacle.

Figure 15:
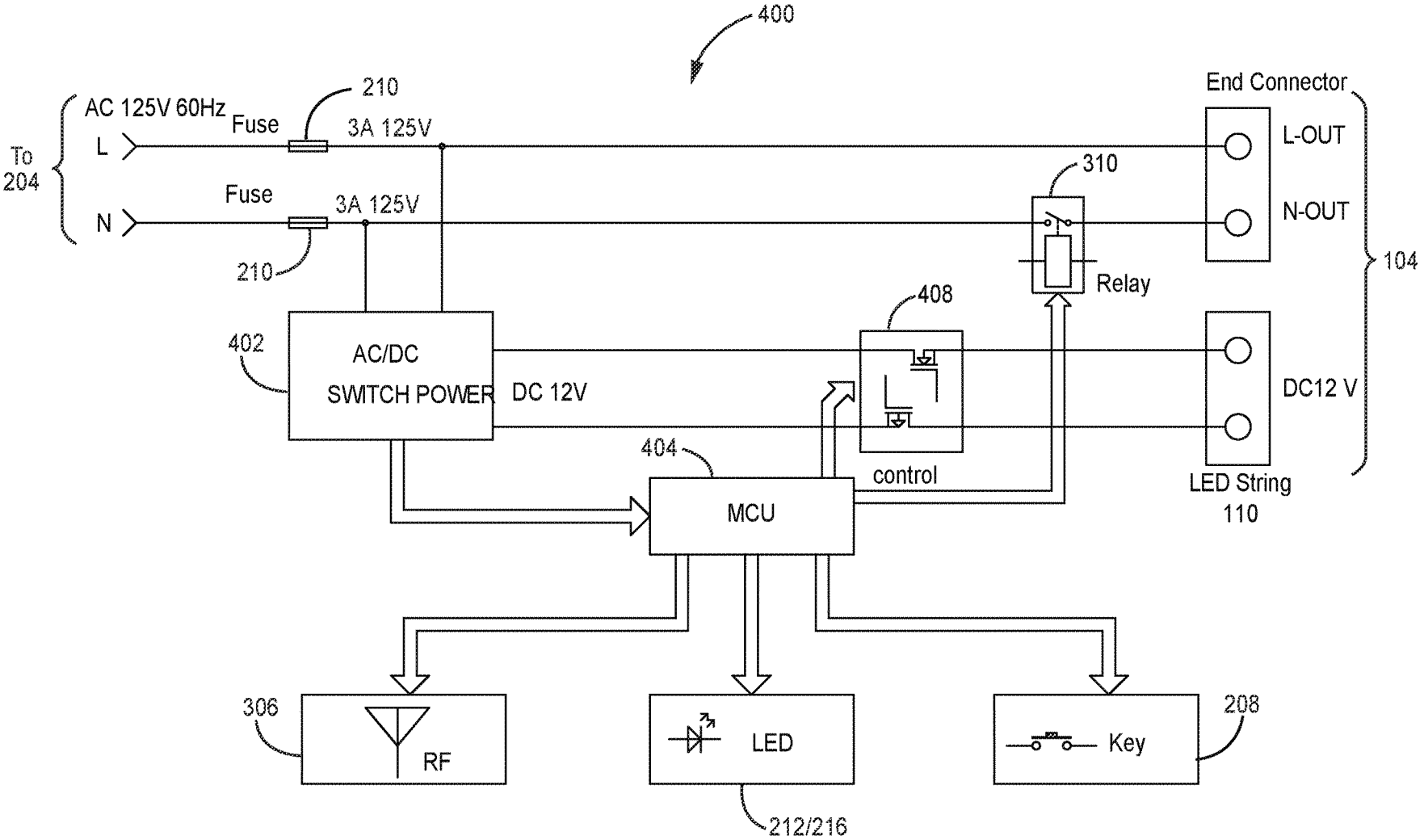
FIG. 15 is a another block diagram of a power and control circuit of a controller-timer for DC lights and an AC power receptacle, according to an embodiment.

Referring to FIG. 15, an electrical block diagram of a power and control circuit 400 of Embodiments 2 and 3 of controller-timer 102 is depicted.

Embodiments 2 and 3 are similar to Embodiment 1, with one difference being that light network 110 includes circuits of LED lights that may be driven both forward and in reverse, or dual polarity circuits. Embodiment 3 is configured for more lights, which in an embodiment, is configured for lights that require more than 24 W of total power, as compared to Embodiment 2, which is configured for lights that require less than 24 W of total power Power and control circuit 400 is substantially similar to circuit 300, with differences being apparent according to the figures.

Figure 16:
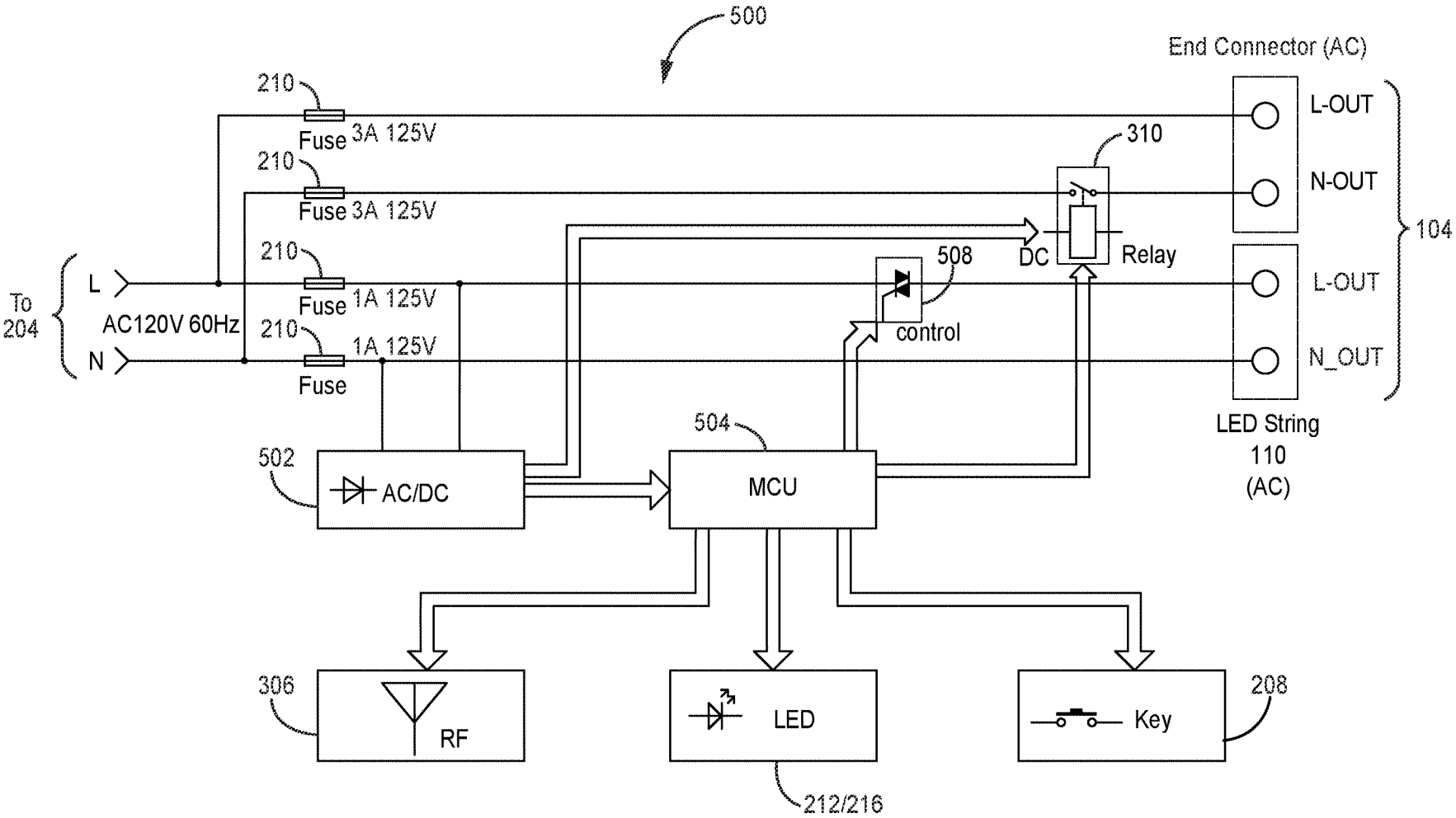
FIG. 16 is a block diagram of a power and control circuit of a controller-timer for AC lights and an AC power receptacle, according to an embodiment.

Referring to FIG. 16, power and control circuit 500 is substantially similar to circuit 300, with differences being apparent according to the figures. In an embodiment, control circuit 508 may include a triac for turning AC power on and off to light network 110.

Figure 17:
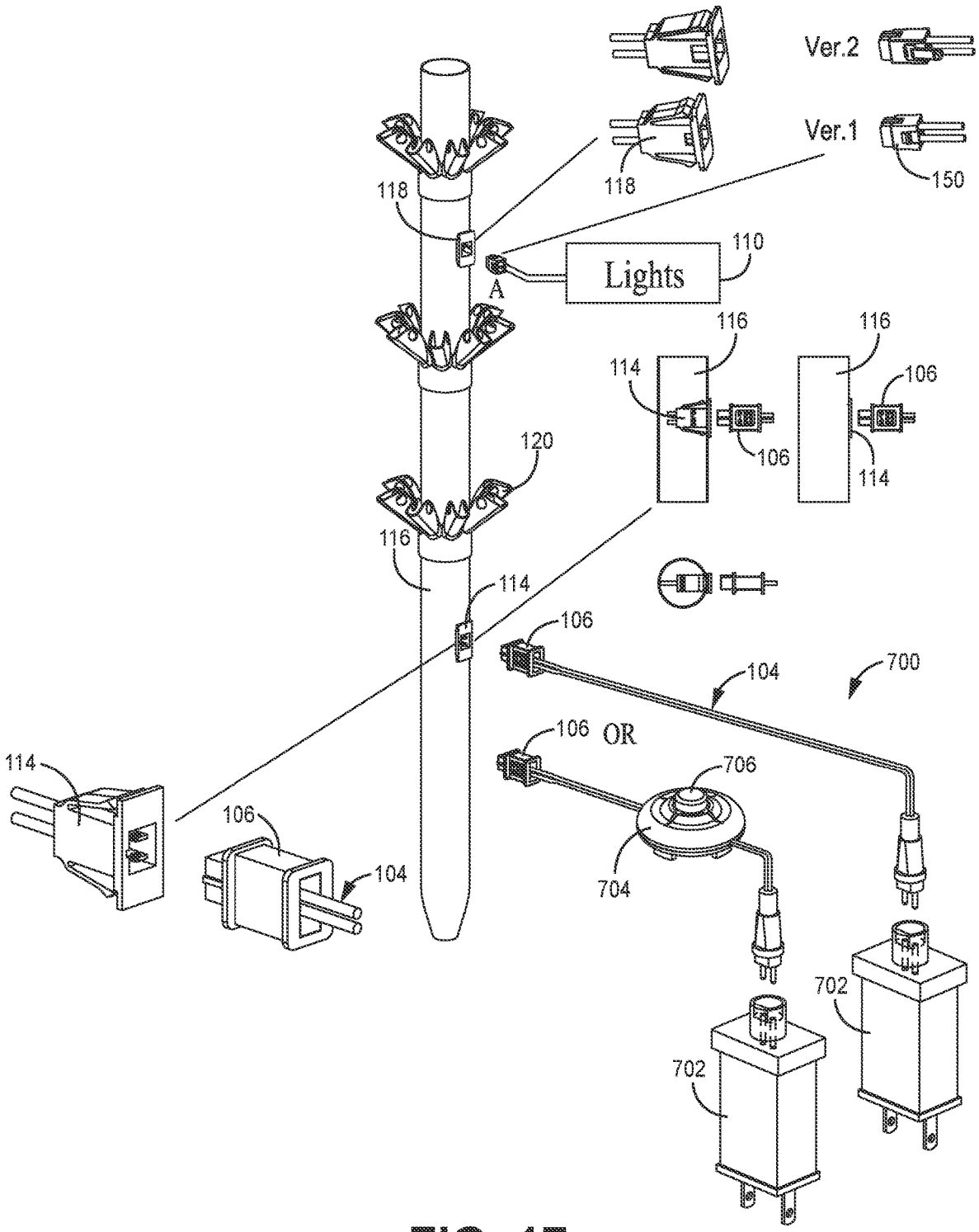
FIG. 17 is a perspective view of a pre-lit tree with a 2-pin DC controller, according to an embodiment.

Referring to FIG. 17, an alternate pre-lit tree 112 with an alternate embodiment of pre-lit controller-timer 102 is depicted. In this alternate embodiment, pre-lit tree 112 is substantially similar to the pre-lit tree 112 of FIG. 2, but does not include an AC-powered end connector, and is 2-terminal or 2-pin based, rather than 4-pin based (compare to FIG. 2). In the depicted embodiment, pre-lit tree 112 includes pre-lit tree controller 700. In this embodiment, only DC power is provided to pre-lit tree 112. In an embodiment, pre-lit tree 112 includes pre-lit tree controller 700, which includes an AC to DC converter (adapter) to convert AC power from an external source to DC power. In an embodiment, controller 700 may also include controller 704 that includes switch 706. Switch 706 may be operated by a user to change light functions or select timer functions. Generally, controller 700 provides timer and function controls in a manner similar to that of control-timer 102.

Figure 18:
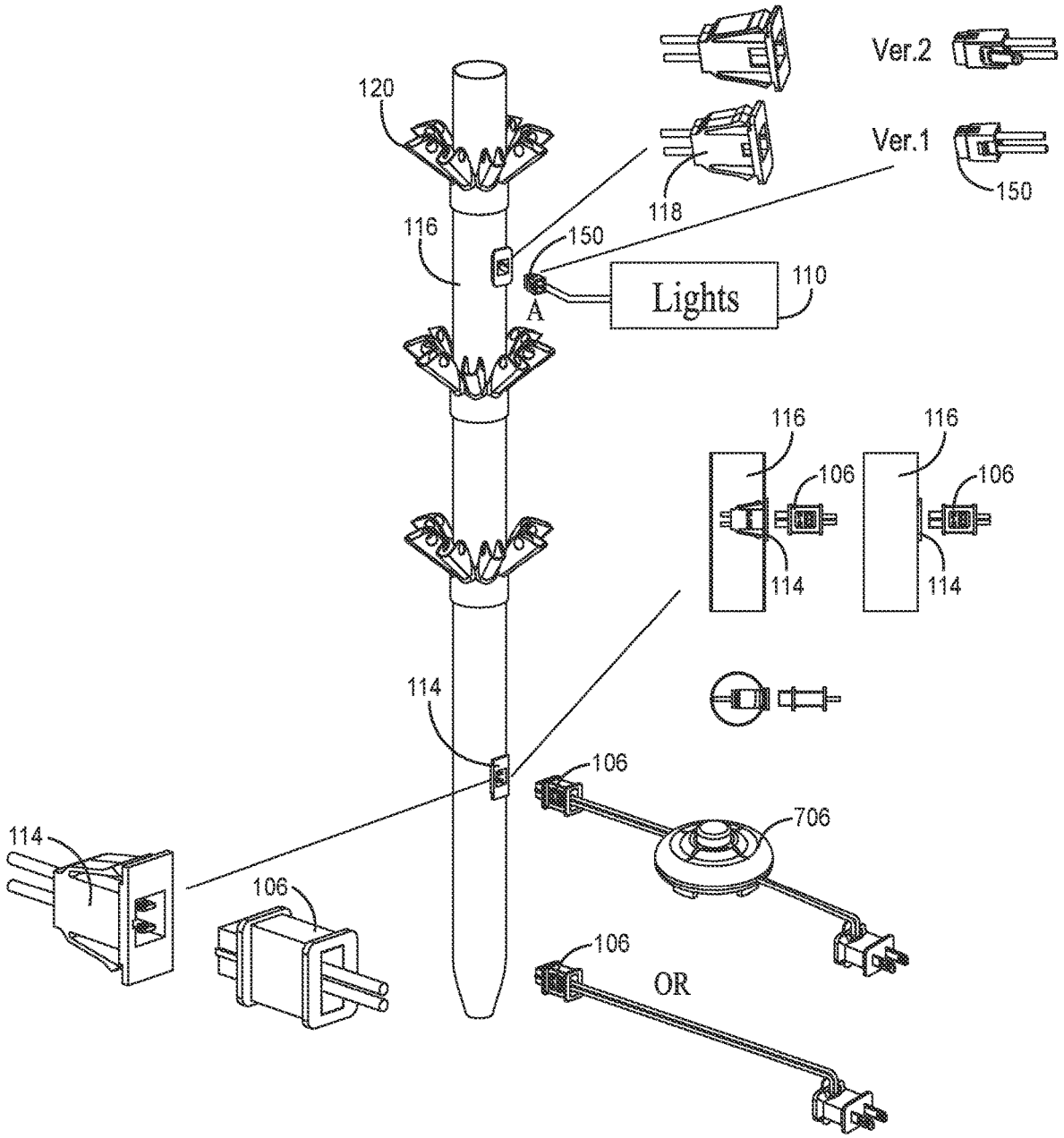
FIG. 18 is a perspective view of a pre-lit tree with a 2-pin AC controller, according to an embodiment.

Referring to FIG. 18, and AC-only pre-lit tree 112 is depicted. In this embodiment, pre-lit tree 112 receives and distributes AC power only.

Figure 19:
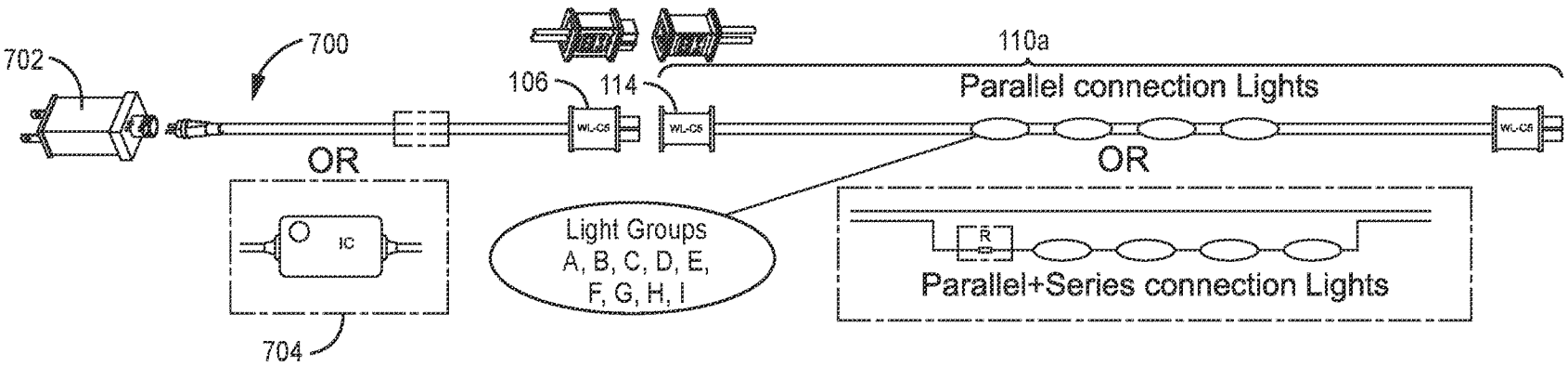
FIG. 19 is a block diagram of a 2-pin controller-timer for use with multiple light networks.

Referring to FIG. 19, rather than a pre-lit tree, controller 700 may be applied to a series of light networks 110 connected in an end-to-end fashion. In an embodiment, multiple light networks 110 may be connected to one another, receiving power and in some embodiments, control signals from controller 700.

Figure 20:
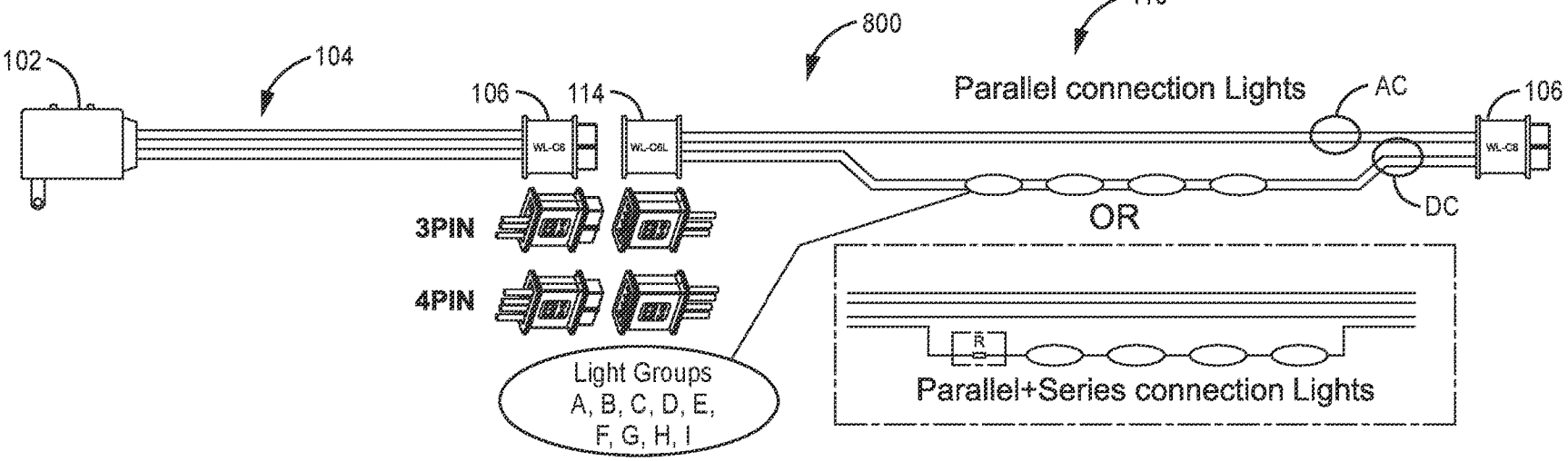
FIG. 20 is a block diagram of a 4-pin controller-timer for use with multiple light networks.

Referring also to FIG. 20, system 800 for controlling a series or sequence of light networks 110 is depicted. In this embodiment, system 800 includes controller-timer 102, connectors 106 and 114, and multiple light networks 110. Operation is similar to that of pre-lit controller 110, though control is applied to a sequence of end to end connected light networks 110.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A multi-sectional artificial tree with power wiring for distributing and controlling power to a network of lights, the tree comprising:

a tree controller;

a first tree section configured to be oriented along a first lengthwise axis, comprising:

a first tree trunk portion extending axially;

a first plurality of branches distributed about a circumference of the first tree trunk portion such that each branch of the first plurality of branches is located at a same first axial level on the first tree trunk portion;

a second plurality of branches distributed about the circumference of the first tree trunk portion such that each branch of the second plurality of branches is located at a same second axial level on the first tree trunk portion;

a first tree-section wiring network located external to the first tree trunk portion and in electrical connection with the tree controller, the first tree-section wiring network comprising a first plurality of tree-section wires, each of the plurality of first tree-section wires comprising a multi-strand conductor and defining a first wire diameter size;

a first branch-level wiring network located at the first axial level and in electrical connection with the first tree-section wiring network, the first branch-level wiring network including a first plurality of light-string connectors electrically connected to one another;

a second branch-level wiring network located at the second axial level and in electrical connection with the first tree-section wiring network, the second branch-level wiring network including a second plurality of light-string connectors electrically connected to one another;

a first plurality of light strings connected to the first plurality of branches and the first branch-level wiring network at the first axial level of the first tree trunk portion, each of the first plurality of light strings connected to only one of the first plurality of branches, each of the first plurality of light strings including a pair of conductors and a plurality of light-emitting diodes electrically connected in parallel, each conductor of the pair of conductors defining a second wire diameter size that is smaller than the first wire diameter size;

a second plurality of light strings connected to the second plurality of branches and the second branch-level wiring network at the second axial level of the first tree trunk portion, each of the second plurality of light strings connected to only one of the second plurality of branches, each of the second plurality of light strings including a pair of conductors and a plurality of light-emitting diodes electrically connected in parallel, each conductor of the pair of conductors defining the second wire diameter size that is smaller than the first wire diameter size;

a first tree-section electrical connector in electrical connection with the tree controller; and a second tree section, comprising:

a second tree trunk portion configured to mechanically couple to the first tree trunk portion;

a third plurality of branches connected to the second tree trunk portion;

a second tree-section wiring network;

a third plurality of light strings connected to the third plurality of branches and in electrical connection with the second tree-section wiring network;

a second tree-section electrical connector configured to mechanically and electrically connect to the first tree-section electrical connector such that the second tree-section wiring network and the third plurality of light strings are in electrical connection with the tree controller.

2. The multi-sectional artificial tree of claim 1, wherein the first tree-section wiring network comprises a first branch-level connector and a second branch-level connector, and the first branch-level wiring network and the second branch-level wiring network are connected to the first branch-level connector and the second branch-level connector, respectively.

3. The multi-sectional artificial tree of claim 2, wherein the first branch-level connector is located at the first axial level and the second branch-level connector is located at the second axial level.

4. The multi-sectional artificial tree of claim 1, wherein the first tree-section wiring network comprises wires extending from the first axial level to the second axial level.

5. The multi-sectional artificial tree of claim 1, wherein the first plurality of light-string connectors are electrically connected to one another in series.

6. The multi-sectional artificial tree of claim 1, wherein the first plurality of tree-section wires comprises 22 AWG wires and the conductors of the first and second plurality of light strings comprise wires that are in the range of 26 AWG to 30 AWG.

7. The multi-sectional artificial tree of claim 6, wherein each of the first plurality of light string connectors connects a 22 AWG wire to the wires that are in the range of 26 AWG to 30 AWG.

8. The multi-sectional artificial tree of claim 1, wherein the quantity of the first plurality of branches is more than the quantity of the second plurality of branches, the quantity of the plurality of the first plurality of light string connectors is more than the quantity of the second plurality of light string connectors, and the second branch-level wiring network further comprises a load resistor electrically connected in series to the plurality of second light string connectors such that a voltage at each of the first plurality of light string connectors is substantially the same as a voltage at each of the second plurality of light string connectors.

9. The multi-sectional artificial tree of claim 6, wherein the tree controller is releasably connected to the first tree trunk portion.

10. The multi-sectional artificial tree of claim 1, wherein the tree controller comprises a timer.

11. The multi-sectional artificial tree of claim 1, further comprising an alternating current (AC) to direct current (DC) converter.

12. The multi-sectional artificial tree of claim 11, wherein the AC to DC converter is housed independently of control circuitry of the tree controller.

13. The multi-sectional artificial tree of claim 11, further comprising an end connector for providing AC power, and wherein the AC to DC converter is in electrical connection with the first and second plurality of light strings.

14. The multi-sectional artificial tree of claim 1, wherein the tree controller is connected to the first tree section via a connector mounted to a sidewall of the first tree trunk portion, and the connector comprises a four-terminal connector, each terminal of the four-terminal connector being connected electrically with a fuse in series.

* * * * *